US008346140B2

(12) United States Patent
Yasumoto

(10) Patent No.: US 8,346,140 B2
(45) Date of Patent: Jan. 1, 2013

(54) BELT MEMBER DRIVING APPARATUS AND IMAGE FORMING APPARATUS HAVING BELT MEMBER DRIVING APPARATUS

(75) Inventor: Takeshi Yasumoto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 140 days.

(21) Appl. No.: 12/787,884

(22) Filed: May 26, 2010

(65) Prior Publication Data

US 2010/0310286 A1 Dec. 9, 2010

(30) Foreign Application Priority Data

Jun. 3, 2009 (JP) ..... 2009-134185

(51) Int. Cl.
*G03G 15/01* (2006.01)

(52) U.S. Cl. ..... 399/302; 399/165; 399/303; 198/804; 198/813

(58) Field of Classification Search ..... 399/165, 399/302, 303, 313; 198/510.01, 804, 810.03, 198/813

See application file for complete search history.

(56) References Cited

U.S. PATENT DOCUMENTS

| | | | | |
|---|---|---|---|---|
| 5,659,851 | A * | 8/1997 | Moe et al. | 399/165 |
| 5,737,003 | A * | 4/1998 | Moe et al. | 347/116 |
| 6,134,406 | A * | 10/2000 | Moe et al. | 399/165 |
| 6,181,900 | B1 * | 1/2001 | Lee et al. | 399/165 |
| 6,804,486 | B2 | 10/2004 | Lee et al. | |
| 6,816,691 | B2 | 11/2004 | Kabata et al. | |
| RE41,934 | E * | 11/2010 | Maruta et al. | 399/227 |
| 7,873,311 | B2 * | 1/2011 | Hara | 399/302 |
| 8,045,905 | B2 * | 10/2011 | Hara | 399/302 |
| 8,112,021 | B2 | 2/2012 | Mochizuki | |
| 2003/0035661 | A1 | 2/2003 | Kabata et al. | |

(Continued)

FOREIGN PATENT DOCUMENTS

CN 1773392 A 5/2006

(Continued)

OTHER PUBLICATIONS

Communication dated Dec. 27, 2010, forwarding a European Search Report dated Dec. 14, 2010, ("European Search Report") in counterpart European Application No. 10164667.7-2209.

(Continued)

*Primary Examiner* — David Gray
*Assistant Examiner* — Francis Gray
(74) *Attorney, Agent, or Firm* — Fitzpatrick, Cella, Harper & Scinto

(57) ABSTRACT

A belt driving apparatus for rotationally driving a belt member, the belt driving apparatus includes a stretching member for stretching the belt member; a steering section including a steering member having a rotatable portion which is rotatable with rotation of the belt member, a frictional portion slidable relative to the belt member and provided at each of longitudinal outsides of the rotatable portion, and further including a supporting section supporting the steering member, and a rotation shaft rotatably supporting the supporting section, the steering section being effective to steer the belt member by inclining the steering member by a force produced by sliding between the frictional portion and the belt member; and a resisting force applying section for applying a resisting force against inclination of the steering member, the resisting force increasing with increase of a rate of change of an inclination angle of the steering member with respect to time.

12 Claims, 11 Drawing Sheets

U.S. PATENT DOCUMENTS

| | | | | |
|---|---|---|---|---|
| 2003/0129000 | A1 | 7/2003 | Lee et al. | |
| 2006/0100046 | A1 | 5/2006 | Fuse | |
| 2007/0283624 | A1 | 12/2007 | Yasumoto | |
| 2008/0260424 | A1* | 10/2008 | Hara et al. | 399/121 |
| 2010/0247174 | A1* | 9/2010 | Hori et al. | 399/303 |

FOREIGN PATENT DOCUMENTS

| | | | |
|---|---|---|---|
| CN | 101324769 | A | 12/2008 |
| EP | 2003512 | A2 | 12/2008 |
| JP | 09-169449 | | 6/1997 |
| JP | 2000-089588 | | 3/2000 |
| JP | 2000-146335 | | 5/2000 |
| JP | 2001-520611 | | 10/2001 |

OTHER PUBLICATIONS

Office Action dated Aug. 24, 2012, in Chinese Application No. 201010196572.3.

* cited by examiner (a)

(b)

BELT MEMBER DRIVING APPARATUS AND IMAGE FORMING APPARATUS HAVING BELT MEMBER DRIVING APPARATUS

FIELD OF THE INVENTION AND RELATED ART

The present invention relates to a belt driving apparatus for driving a belt involved in image formation. More concretely, it is an invention related to a belt driving unit for driving an intermediary transfer belt, a direct transfer belt, a photosensitive belt, etc. It also relates to image forming apparatuses such as copying machines, printers, etc., which have a belt driving unit. It also is effectively applicable to a belt (for example, belt for conveying recording medium, and fixation belt of fixing apparatus), which is not directly involved in image formation.

In recent years, image forming apparatuses have been substantially increased in operational speed. There has been a substantial increase in the operational speed of an image forming apparatus. With the increase in operational speed, image forming apparatuses which have multiple image forming portions have become the mainstream image forming apparatuses. In the case of these apparatuses, they are provided with a belt along which multiple image forming portions are aligned in the direction parallel to the moving direction of the belt, and the image forming operations for forming multiple monochromatic images, different in color, are sequentially carried out in a partially overlapping manner. As an example of such a belt, the intermediary transfer belt employed by electrophotographic full-color image forming apparatuses can be listed as a representative one. In an image forming operation of a typical electrophotographic full-color image forming apparatus employing an intermediary transfer member, multiple monochromatic toner images, different in color, are sequentially transferred in layers onto the surface of the intermediary transfer belt, and then, the layered toner images on the intermediary transfer belt are transferred all at once onto recording medium. This type of intermediary transfer belt is suspended and kept stretched by multiple rollers, for example, a belt driving roller (driver roller), to begin with, and is circularly drivable. A belt which is supported and kept stretched by multiple rollers has been known to suffer from the problem that while it is driven, it deviates in position in its widthwise direction, because of the inaccuracy in terms of the external diameter of the rollers, and/or alignment among the belt supporting rollers.

As one of the means proposed to deal with the above described problem (belt deviation), there has been known a method for controlling a steering roller with the use of an actuator (Japanese Laid-open Patent Application H09-169449). Also known as a means to deal with the above-described problem is a structural arrangement which provides an image forming apparatus with a member for regulating the belt deviation (Japanese Laid-open Patent Application 2000-146335).

However, the means disclosed in Japanese Laid-open Patent Application H09-169449 is problematic in that it requires a complicated control algorithm, and also, its high cost attributable to electrical components, such as sensors and actuators, which it requires. The structural arrangement disclosed in Japanese Laid-open Patent Application 2000-146335 does not require sensors and actuators, but, it keeps the regulating member continuously subjected to the force which the belt deviation, generates, limiting thereby the highest speed at which the image forming apparatus can be operated. Further, this solution is problematic in that it is high in the cost for examining and controlling the accuracy with which the regulating member is attached (pasted).

There has been proposed another method for controlling the belt deviation (Japanese Laid-open Patent Application 2001-520611). This method has been known to be smaller in component count, simple, and low in cost. According to this patent application, a steering roller (steering member) automatically centers a belt based on the difference in frictional resistance.

Referring to FIG. 12, the belt centering automatic mechanism disclosed in Japanese Laid-open Patent Application 2001-520611 has a steering mechanism such as the one shown in FIG. 12. That is, a steering member 97 is made up of a roller 90 and a pair of end members 91. The roller 90 is rotatable by the rotation of the belt, whereas the end rollers 91 are not rotatable by the rotation of the belt. The steering member 97 is supported by a supporting plate 92 in such a manner that the steering member 97 is rotationally movable in the direction indicated by an arrow mark S, about a steering axle 93. The supporting plate 92 is kept pressed in the direction indicated by an arrow mark K by a tension providing portion 95 which can be compressed by a pressure increasing cam 96, so that the peripheral surface of the steering member presses on the inward surface of the unshown belt in a manner to increase the belt in tension.

Next, referring to FIG. 13, the principle of the automatic centering of the belt will be described.

As described already, the end members 91 are held so that they do not follow the belt movement. Therefore, they are always subjected to the friction generated between them and the inward surface of the belt.

FIG. 13(*a*) is a schematic sectional view of the combination of one of the end members 91 and a belt 50 when the belt 50 is being driven in the direction indicated by an arrow mark V by being wrapped around the end member 91. The angle by which the belt 50 wraps around the end member 91 is θs. Here, it is assumed that the width of contact between the end member 91 and belt 50 is a unit width. To think of the belt length equivalent to a differential angle dθ of a given belt wrap angle θ, the belt is slack on the upstream side of the steering member, and is tense on the downstream side of the steering member. Thus, if the belt tension on the upstream side is T, the belt tension on the downstream side is T+dT. These tensions work in the direction parallel to the tangential line to the steering member. Therefore, the amount of force which the belt applies to the end member 91 toward the center of the end member 91 per differential belt length is approximately Tdθ. Thus, if the coefficient of friction between the belt 50 and end member 91 is μs, the amount of friction dF between the belt 50 and end member 91 can be obtained from the following mathematical equation:

$$dF=\mu sTd\theta \tag{1}$$

The tension T is governed by an unshown belt driving roller. Thus, if the coefficient of friction of the belt driving roller is νr, $$dT=\mu rTd\theta \tag{2}$$

Thus, $$\frac{dT}{T}=-\mu_r d\theta \tag{2'}$$

Integrating Equation (2') over angle of wrap θs, the amount of the tension T is obtainable from the following mathematical equation:

$$T=T_1e^{-\mu r\theta} \tag{3}$$

Here, $T_1$ stands for the amount of tension at where θ=0. From Equations (1) and (3), $$dF=\mu_sT_1e^{-\mu_r\theta}d\theta \tag{4}$$

Referring to FIG. 13(*a*), assuming that the direction in which the supporting plate 92 rotates relative to the steering shaft is the direction indicated by an arrow mark S, there is an angle α between the plane of the steering member rotation and the line which connects the point (θ=0) at which the belt begins to wrap around the steering member and the axial line of the end member 91. Therefore, the component of the force obtainable from Equation (4), which is downwardly directed as indicated by an arrow mark S, is:

$$dFs=\mu sT_1e^{-\mu r\theta}\sin(\theta+\alpha)d\theta) \quad (5)$$

Integrating Equation (5) with the angle θs of wrap, $$F_s=\mu_sT_1\int_0^{\theta_s}e^{-\mu,\theta}\sin(\theta+\alpha)d\theta \quad (6)$$

The amount of the downward force (per unit width), indicated by the arrow mark S, which each end member 91 receives from the belt 70 when the belt 50 is being driven can be obtained from Equation (6).

FIG. 13(*b*) is a plan view of the steering member and belt 50, as seen from the direction indicated by an arrow mark TV in FIG. 13(*a*). Referring to FIG. 13(*b*), it is assumed that as the belt 50 is driven in the direction of the arrow mark V, the belt 50 deviates leftward. Thus, the belt 50 is in contact with only the left end member 91. It is also assumed that the width of the area of contact between the belt 50 and left end member 91, that is, the distance between the left edge of the belt 50 and the inward edge of the left end member 91, is w. Thus, the left end member 91 is subjected to a downward force Fsw, directed as indicated by the arrow mark S, whereas the right end member 91 is subjected to no force directed as indicated the arrow mark S. It is reasonable to explain that the difference between the left and right end members 91 in the amount of the friction between them and the belt is the origin of the force that generates the moment FswL (steering roller tilt so that left side, that is, side to which belt has deviated, downwardly moves). Hereafter, the moment which causes the steering member to rotationally move about the steering shaft will be referred to as steering torque.

The direction in which the steering member 97 is tilted by the force resulting from the above described principle is equivalent to the direction in which the belt 50 is to be shifted back. Therefore, the belt 50 is automatically centered.

However, the method for automatically centering the belt, which is proposed in Japanese Laid-open Patent Application 2001-520611, is problematic in that because the steering member 97 is allowed to freely rotate about the steering shaft 95, the steering member 97 is too easily affected by (excessively sensitive to) external shocks. That is, in the case of an intermediary transfer belt, the turning-on, or turning-off, of the electrostatic load in the primary transfer portion, the entrance of a sheet of transfer medium into the second transfer portion, and the like, may be listed as the external shocks.

In the case of the belt centering automatic mechanism disclosed in Japanese Laid-open Patent Application H09-1694449, which is controlled with the use of an actuator or the like, even if the belt steering mechanism is subjected to a large amount of external shock, the inertia of the motor, etc., plays the role of preventing the steering member 97 from being excessively affected by the external shock.

On the other hand, in the case of the belt centering automatic mechanism shown in FIGS. 13(*a*) and 13(*b*), the steering member 97 does not have such inertia as the above described one. Therefore, the steering member 97 is likely to be rotationally moved by a wide angle. As the steering member 97 is rotationally moved by a wide angle while the belt 50 is being circularly driven, the belt 50 is made to rapidly change in the attitude in which it is supported and kept stretched. In the case of a belt involved in image formation, its positional deviation in its widthwise direction results in the misalignment of multiple monochromatic images, different in color, in the primary scan direction.

Next, referring to FIGS. 14 and 15, the relationship between the changes in the attitude of the belt 50, and the misalignment of multiple monochromatic images, different in color, in the primary scan direction, will be described.

FIG. 14 is a top plan view of the belt 50 when the belt 50 is being driven and is stable in attitude. The belt 50 is suspended and kept stretched by multiple rollers, that is, a driver roller 604 and steering roller member 97, etc. The belt position indicated by a solid line in FIG. 14 is the belt position at a given point t in time when the belt 50 is being circularly driven. The belt 50 is tilted (in attitude γ) due to the misalignment among the rollers, or the like.

If the belt 50 is driven in the direction indicated by an arrow mark V while remaining in the attitude γ, the belt 50 will be in the position indicated by a broken line at a point (5+Δt) in time. If it is assumed that the position of one of the belt edges in terms of the widthwise direction of the belt is measured at points M1 and M2 at times t and t+Δt, respectively, the point Pt of the belt edge, which is at the point M when the belt edge position is measured, and the point $P_{t+\Delta t}$, which is at the point M when the belt edge position is measured, are the same point of the belt edge. Thus, if there is no belt deviation, the position of the point Pt and the position of the point $P_{t+\Delta t}$ in terms of the belt width direction should coincide.

In a case where the belt 50 remains stable in attitude γ while being driven, the locus of the point P of the belt edge between the point Pt and $P_{t+\Delta t}$ is parallel to the direction x. In other words, the belt 50 is in the ideal condition. That is, there is no positional deviation of the belt 50 in the direction y (primary scan direction) between the belt edge position detecting points M1 and M2.

FIG. 15 is a top plan view of the belt 50 when the belt 50 does not remain stable in attitude while being driven. Assuming that the belt 50 is in the position indicated by a solid line as shown in FIG. 14, at a given point t in time, and is in the attitude γ, and also, that if the belt 50 changes in attitude γ while being driven in the direction indicated by an arrow mark V, the position of the belt 50 at point $P_{t+\Delta t}$ in time will be as indicated by a broken line. If the position of the point P of one of the belt edges is measured at the same points M1 and M2 as those in FIG. 14, the locus of the point P from the point Pt to the $P_{t+\Delta t}$ is tilted relative to the direction x (secondary scan direction). That is, the position Pt, that is, the position of the point P at point t in time, and the position $P_{t+\Delta t}$, that is, the position of the point P at point t+Δt in time, do not coincide in terms of the direction y (secondary scan direction). Thus, if it is assumed that the belt edge position detecting points M1 and M2 are the positions of the image forming portions for the first and second monochromatic images, respectively, the positional deviation of the belt 50 in the primary direction is equivalent to the positional deviation between the first and second monochromatic images, different in color, in the primary scan direction. In other words, in a case where a belt is involved in image formation as is the belt 50, the changes which occur to the attitude of the belt results in the positional deviation of the monochromatic images, different in color, relative to each other in the primary scan direction. As the image forming apparatus is suddenly subjected to a large amount of external disturbance, the steering member 97 is rotationally moved in the direction indicated by the arrow mark S by a substantial amount, and therefore, the belt 50 is changed in attitude by a large amount.

FIG. 16 is a graph which shows the relationship between the positional deviation of the belt 50 caused in the primary scan direction by a large amount of external disturbance, and the length of time having elapsed after the occurrence of the shock. The vertical axis represents the positional deviation of the belt 50 in the primary direction, which was detected by measuring the position of the given point of one of the edge of the belt 50 at Points M1 and M2 described with reference to FIGS. 14 and 15.

Referring to FIG. 16, when the belt 50 was being driven under the control which automatically keeps the belt 50 centered, it was suddenly subjected to a large amount of external disturbance at a point E in time, whereby it was made to severely deviate in position. Then, it was restored in operational condition (normal oscillatory centering movement) after the elapse of the length Tr of time. When the belt 50 is under the control which automatically keeps the belt 50 centered, the steering member 97 remains small in its rotational movement (so-called steering movement) in the direction S as long as it is not suddenly subjected to a large amount of external disturbance or the like. Therefore, the positional deviation of the belt 50 in the primary scan direction is very small, that is, it remains at a non-problematic level. However, the positional deviation of the belt 50, which occurs the moment the image forming apparatus is suddenly subjected to a large amount of external disturbance, and the subsequent period Tr in which the steering member 97 is aggressively steering the belt 50, is very large.

In the case of Japanese Laid-open Patent Application 2001-520611, the supporting plate 92 is provided with a pair of leaf springs 98, which are at the lengthwise ends of the plate 92, one for one, and the two leaf springs 98 function as a means for regulating the rotational movement of the steering member 97, which occurs when the image forming apparatus (belt steering member) is suddenly subjected to a large amount of external disturbance, such as those described above.

In the case of Japanese Laid-open Patent Application 2001-520611, however, if the image forming apparatus (belt steering member) is suddenly subjected to a large amount of load, the springs 98 are likely to excessively respond as a shock damping absorbing means during the period Tr; they are likely to cause the steering member 97 to overshoot (points $OS^1$, $OS_2$, $OS_3$ . . . ). Further, the steering member 97 changes in the direction, in which it rotationally moves, at the points $OS^1$, $OS_2$, $OS_3$ . . . , as shown in FIG. 17(*a*). Thus, not only does the overshooting exacerbate the misalignment of the monochromatic images, different in color, in terms of the primary scan direction, but also, delays the centering of the belt 50. In other words, the overshooting is one of the reasons why this belt centering automatic mechanism is slow to react to automatically center the belt.

Therefore, the structural arrangement which regulates the rotational movement of the belt steering member 97 by providing a resistance R, the amount of which is proportional to the steering angle β as shown in FIG. 17(*a*), is undesirable. Thus, what has been desired is a structural arrangement which can significantly more quickly centers the belt 50 than any of the conventional belt centering automatic mechanisms, even if the steering member is suddenly changed in steering angle.

SUMMARY OF THE INVENTION

The primary object of the present invention is to provide an image forming apparatus the belt steering member of which is superior in shock resistance to any of the conventional image forming apparatuses which employ a belt steering member.

According to an aspect of the present invention, there is provided a belt driving apparatus for rotationally driving a belt member, said belt member driving apparatus comprising a stretching member for stretching the belt member; steering means including a steering member having a rotatable portion which is rotatable with rotation of the belt member, a frictional portion slidable relative to the belt member and provided at each of longitudinally outsides of said rotatable portion, and further including supporting means supporting said steering member, and a rotation shaft rotatably supporting said supporting means, said steering means being effective to steer the belt member by inclining said steering member by a force produced by sliding between said frictional portion and the belt member; and resisting force applying means for applying a resisting force against inclination of said steering member, the resisting force increases with increase of rate of change of an inclination angle of said steering member with respect to time.

According to another aspect of the present invention, there is provided an image forming apparatus for forming an image comprising said belt, and said belt driving apparatus.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

<Image Forming Apparatus>

Next, the image forming apparatus in this embodiment of the present invention will be described.

Figure 1:
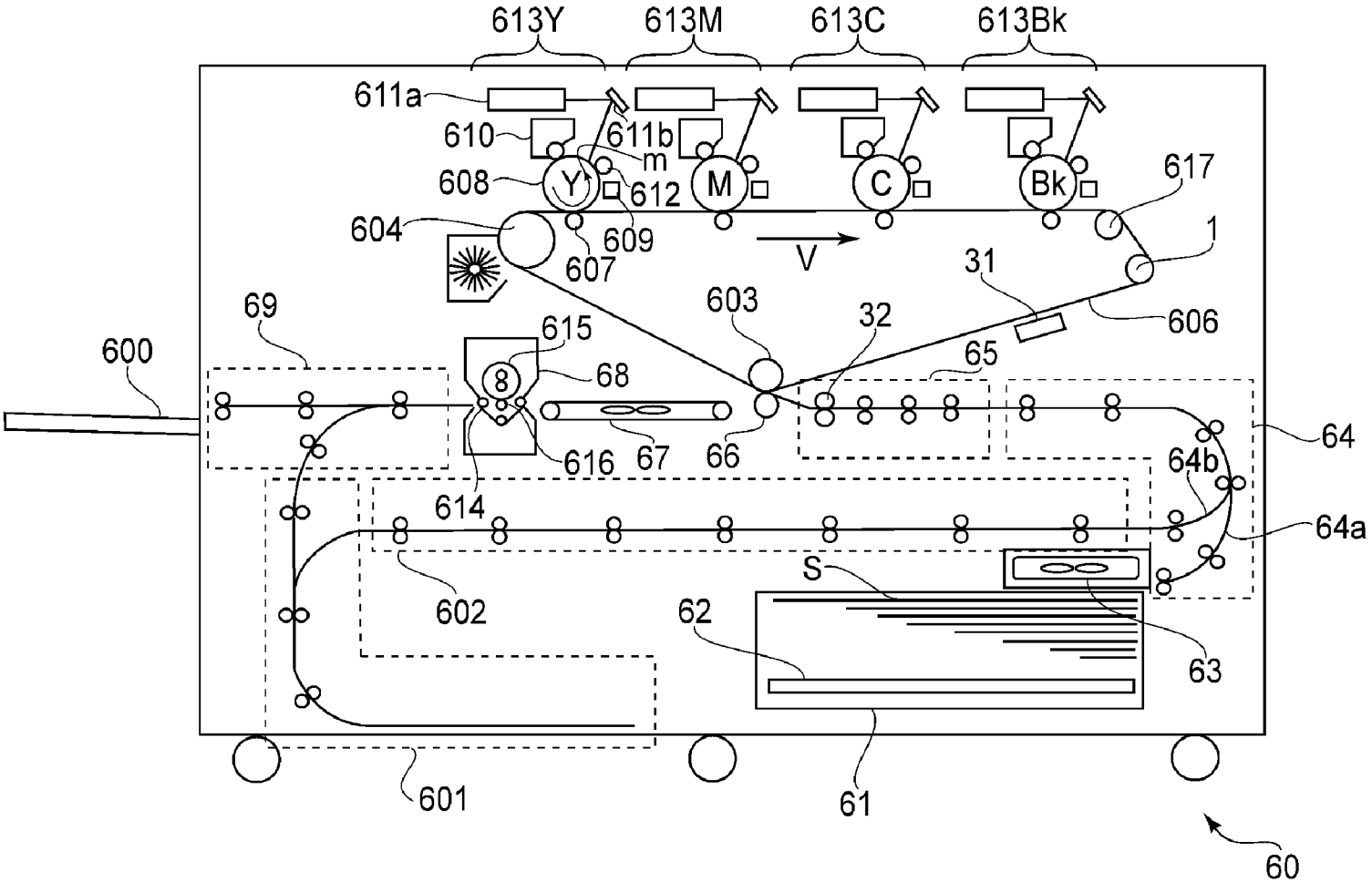
FIG. 1 is a sectional view of a typical image forming apparatus which employs an intermediary transferring means.

First, referring to FIG. 1, the operation of the image forming apparatus will be described. As image forming methods used by image forming apparatuses, an electrophotographic method, an offset method, an inkjet method, etc., may be listed. The image forming apparatus 60 shown in FIG. 1 is a color image forming apparatus which uses an electrophotographic method. The image forming apparatus 60 has: four image forming portions which are different in the color in which they form images; and an intermediary transfer belt. The four image forming portions are on the top side of the intermediary transfer belt, and are serially arranged in the direction parallel to the moving direction of the intermediary transfer belt. In other words, the image forming apparatus 60 is of the so-called tandem type, as shown in FIG. 1 which is a sectional view of the apparatus 60. In recent years, this type of image forming apparatus has become a mainstream image forming apparatus because of its superiority in terms of the compatibility with thick paper, and also, productivity.

<Conveyance of Transfer Medium>

Multiple sheets S of recording medium are stored in layers in a recording medium storing portion 61, being supported by a recording medium lifting apparatus 62. The sheets S of recording medium are fed into the main assembly of the image forming apparatus 60 by a sheet feeding apparatus 63, in synchronism with the progression of an image forming operation. One of the methods for separating one of the sheets of recording medium in the recording medium storing portion is the method which separates one of the sheets S of recording medium from the rest by suction (vacuum). The image forming apparatus 60, shown in FIG. 1, uses this recording medium separating method. Obviously, the recording medium feeding method other than the one used the image forming apparatus 60 may be used. As a sheet S of recording medium (which hereafter will be referred to simply as recording sheet S) is fed into the apparatus main assembly by the sheet feeding apparatus 63, it is conveyed through a recording sheet conveyance path 64*a* of the recording sheet conveyance unit 64, and then, is conveyed to a recording sheet registering apparatus 65. After it is corrected in attitude and conveyance timing by the recording sheet registering apparatus 65, it is sent to a second transferring portion, which is a nip formed by a pair of rollers 603 and 66, which oppose each other with the presence of an intermediary transfer belt 606 between the two rollers. The rollers 603 and 60 are the first and second rollers, respectively, of the second transfer portion. Then, the recording sheet S is conveyed through the second transfer portion while a preset amount of pressure and a preset electrostatic bias (load) are applied to the recording sheet S and the unfixed toner images thereon. As a result, the toner images on the intermediary transfer belt 606 are transferred onto the recording sheet S.

<Image Formation Process>

Next, the image formation process which is carried out in synchronism with the above described conveyance of the recording sheet S to the second transfer portion will be described.

The image forming apparatus 60 in this embodiment has: an image forming portion 613Y which forms an image with the use of yellow (Y) toner; an image forming portion 613M which forms an image with the use of magenta (M) toner; an image forming portion 613C which forms an image with the use of cyan (C) toner, and an image forming portion 613BK which forms an image with the use of black (BK) toner. The image forming portions 613Y, 613M, 613C, and 613BK are the same in structure although they are different in the color of the toner they use. Thus, the image formation process will be described with reference to the image forming portion 613Y.

The image forming portion 613Y, which is a toner image forming means, is made up of: a photosensitive member 608, which is an image bearing member; a charging device 612 for charging the photosensitive member 608; an exposing apparatus 611*a*; a developing apparatus 610; a first transferring apparatus 607; and a photosensitive member cleaner 609. The photosensitive member 608 is rotated in the direction indicated by an arrow mark m in the drawing. As the photosensitive member 608 is rotated, its peripheral surface is uniformly charged by the charging device 612. The charged portion of the peripheral surface of the photosensitive member 608 is exposed by the exposing apparatus 611*a*. More specifically, as the exposing apparatus 611*a* is driven, a beam of light is projected from the exposing apparatus 611*a*, while being modulated by the inputted signals which reflect the information of the image to be formed. This beam of light is deflected so that it scans the charged area of the peripheral surface of the photosensitive member 608. As a result, an electrostatic latent image is effected upon the peripheral surface of the photosensitive member 608. Then, the electrostatic latent image is developed by the developing apparatus 610. As a result, a visible image is formed of toner (yellow toner, in this case), on the peripheral surface of the photosensitive member 608 (this visible image will be referred to as toner image, hereafter). Then, the yellow toner image is transferred onto the intermediary transfer belt 606, which is the first transfer member, by a preset amount of pressure applied by the first transferring member 607 and a preset amount of electrostatic bias (load) applied between the photosensitive member 608 and first transferring member 607. Thereafter, the transfer residual toner, that is, the toner remaining on the peripheral surface of the photosensitive member 608 after the transfer, is recovered by the photosensitive member cleaner 609, to prepare the photosensitive member 608 for the next image formation.

There are four image forming portions 613, that is, image forming portions for forming yellow (Y), magenta (M), cyan (C), and black monochromatic toner images, one for one, in the image forming apparatus 60, shown in FIG. 1. Therefore, a magenta toner image formed in the image forming portion M is transferred onto the intermediary transfer belt 606 in such a manner that it is layered upon the yellow toner image on the intermediary transfer belt 606. The cyan toner image formed in the image forming portion C is transferred onto the intermediary transfer belt 606 in such a manner that it is layered on the yellow and magenta toner images on the intermediary transfer belt 606. Further, the black toner image formed in the image forming portion BK is transferred onto the intermediary transfer belt 606 in such a manner that it is layered upon the yellow, magenta, and cyan toner images on the intermediary transfer belt 606. As the monochromatic toner images, which are different in color, are layered upon the intermediary transfer belt 606 as described above, a full-color image is effected on the intermediary transfer belt 606. Although the image forming apparatus in this embodiment uses four colors (color toners) to form a full-color image, the number of colors does not need to be limited to four. Further, the order in which monochromatic toner images, different in color, are formed and transferred, does not need to be limited to the above described one.

Next, the intermediary transfer belt 606 will be described. The intermediary transfer belt 606 is supported and kept stretched by four rollers, more specifically, a driver roller 604 which is a belt driving member; a steering roller 1, which is a belt steering member; a tension roller 617 which is a belt tensioning member; and a second transfer roller 603 which is on the inward side of the loop which the belt forms. The intermediary transfer belt 606 is an endless belt, and is driven in the direction indicated by the arrow mark V in the drawing.

The steering roller 1 functions also as a belt tensioning roller, which provide the intermediary transfer belt 606 with a preset amount of tension, in coordination with the tension roller 617. The above described image formation process is carried out in the image forming portions 613Y, 613M, 613C, and 613BK, with such timings that the image formed in the downstream image forming portion of the adjacent two image forming portions will be transferred onto the intermediary transfer belt 606 in such a manner that it will be layered upon the image having formed in the upstream image forming portion and having transferred upon the intermediary transfer belt 606. Consequently, a full-color toner image is effected upon the intermediary transfer belt 606. This full-color toner image is conveyed to the second transfer portion. Incidentally, the number of the rollers by which the intermediary transfer belt 606 is supported and kept stretched, does not need to be limited to that in FIG. 1.

<Process after Second Transfer>

As the recording sheet S is conveyed to the second transfer portion in synchronism with the formation of the full-color toner image on the intermediary transfer belt 606, the full-color toner image formed through the above described image forming process and transferred onto the intermediary transfer belt 606 is transferred onto the recording sheet S in the second transfer portion. Then, the recording sheet S is conveyed to the fixing apparatus 68 by a recording medium conveying portion 67, which is between the second transfer portion and fixing apparatus 68. Although there are many structural arrangements and fixing methods for a fixing apparatus, the fixing apparatus 68, which is shown in FIG. 1, is of the type that welds the toner image on the recording sheet S to the recording sheet S by applying a preset amount of pressure and a preset amount of heat to them, in its fixation nip which fixation roller 615 and pressure belt 614 of the fixing apparatus 68 form. More specifically, the fixing roller 615 has an internal heater as an heat source. The pressure belt 614 is supported and kept tensioned by multiple rollers, and is kept pressed upon the fixation roller 615 by a pressing pad 616 from the inward side of the pressure belt loop. After being conveyed through the fixing apparatus 68, the recording sheet S is directly discharged into a delivery tray 600 by a recording sheet directing-and-conveying apparatus 69, if the image forming apparatus is not in the two-sided printing mode. If the image forming apparatus is in the two-sided mode, the recording sheet S is conveyed to a turning-and-conveying apparatus 601. When the image forming apparatus is in the two-sided-printing mode, the recording sheet S is sent to the turning-and-conveying apparatus 601, and is turned over so that the edge of the recording sheet S, which was the leading edge, becomes the trailing edge, and then, is conveyed to a conveying apparatus 602. Then, the recording sheet S is conveyed again to the second transfer portion through a re-feeding passage 64*b*, which the recording medium conveyance unit 64 has, with such a timing that it does not collide with the next recording sheet S sent from the sheet feeding apparatus 61. The process for forming an image on the reverse side (second surface) of the recording sheet S is the same as the above described process for forming an image on the top surface (first surface) of the recording sheet S, and therefore, will not be described here.

<Structural Arrangement for Steering Intermediary Transfer Belt>

Figure 2:
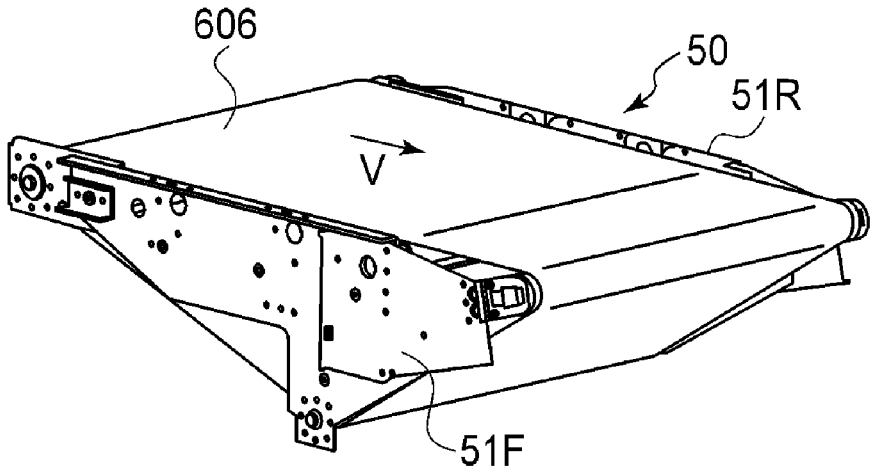
FIGS. 2(*a*) and 2(*b*) are perspective views of the intermediary transfer belt unit of the image forming apparatus in the first embodiment of the present invention.
Figure 2:
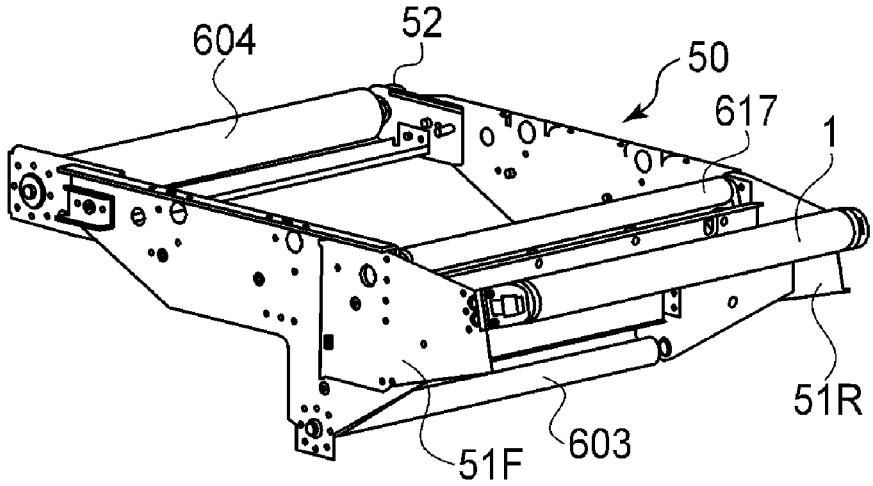

FIGS. 2(*a*) and 2(*b*) are perspective views of the intermediary transfer belt unit 50 of the image forming apparatus 60 shown in FIG. 1. FIG. 2(*a*) includes the intermediary transfer belt 606, whereas FIG. 2(*b*) does not include the intermediary transfer belt 606. The intermediary transfer belt 606 is driven in the direction indicated by an arrow mark V, by the rotation of the driver roller 604, which is a belt driving member, into which the belt driving force is inputted through a driving gear 52, which is a driving force transmitting member. The intermediary transfer belt steering mechanism (which hereafter will be referred to simply as belt steering mechanism) in this embodiment is a belt centering automatic mechanism which utilizes the difference in friction between the lengthwise end portions of the steering roller 1, which is a belt steering member.

Figure 3:
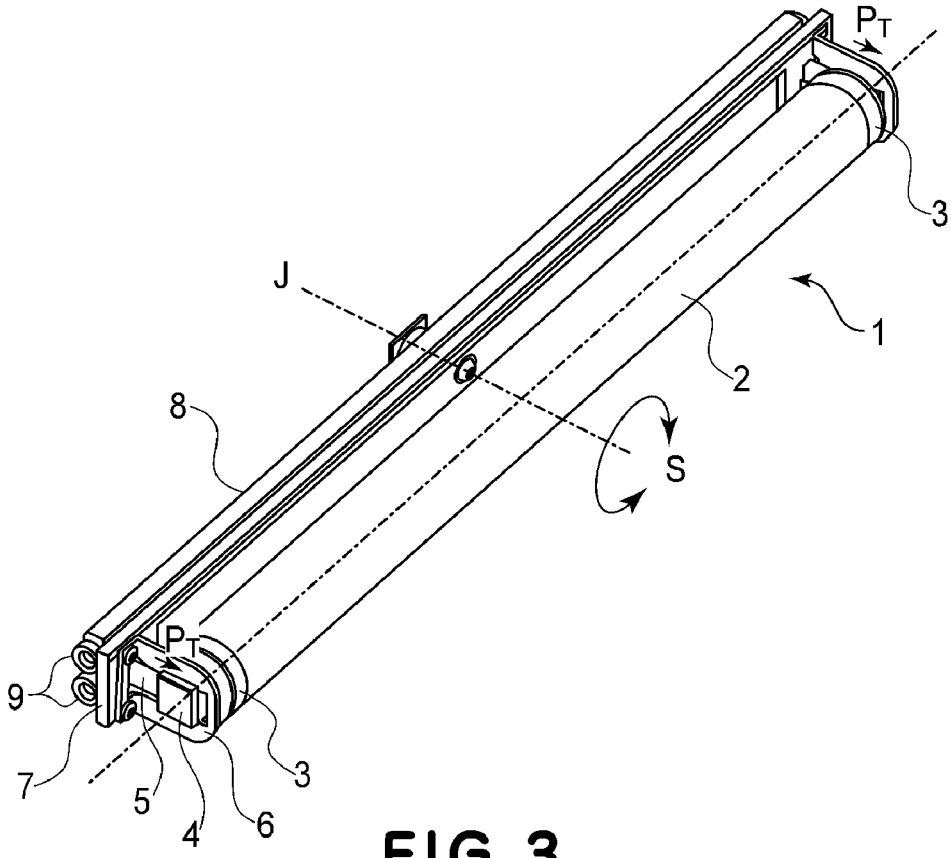
FIG. 3 is a perspective view (1) of the belt centering automatic mechanism in the first embodiment of the present invention.

FIG. 3 is a perspective view of the belt centering automatic mechanism (apparatus), which is a belt steering means in accordance with the present invention. The steering member 1, has: a roller 2, which is the center (primary) portion; and a pair of friction rings 3, which are at the lengthwise ends of the roller 2, in terms of the direction parallel to the axial line of the roller 2, and function as friction generating portions (friction ring). The roller 2 and friction rings 3 are mounted on the same shaft. The steering member 1 has also: a pair of supporting members 6, a pair of bearings 4, and a pair of pressure providing springs 5 (compression springs), which are elastic members. Each bearing 4 is fitted in the groove (unshown) of the corresponding supporting member 6 so that it is allowed to move in the direction indicated by an arrow mark PT in the drawing. Further, the bearing 4 is kept pressed in the direction indicated by the arrow mark PT by the corresponding spring 5. Thus, the steering member 1 also functions as a belt tensioning member which presses on the inward surface of the intermediary transfer belt 606 to provide the intermediary transfer belt 606 with such a tension that is directed as indicated by an arrow mark K'. The pair of supporting members 6 and a plate 7 constitute a supporting member for supporting the roller 2 and frictional rings 3. The supporting member 6 is supported by a steering shaft so that it can be rotated in the direction indicated by the arrow mark S about the steering shaft axis J, which coincides with the center of the roller 2. Designated by a referential cod 8 is a frame stay which is the frame of the intermediary transfer belt unit 500. The frame stay 8 extends between the front and rear plate 51F and 51R, respectively, of the intermediary transfer belt unit 500. It is provided with two pairs of slide rollers 9, which are at the lengthwise ends of the frame stay 8, one for one. The rollers 9 play the role of reducing the plate 7 in rotational resistance.

<Details of Structure of Belt Centering Automatic Mechanism>

Next, referring to FIGS. 4, 5(*a*), and 5(*b*), the structure of the belt centering automatic mechanism will be described in more detail.

Figure 4:
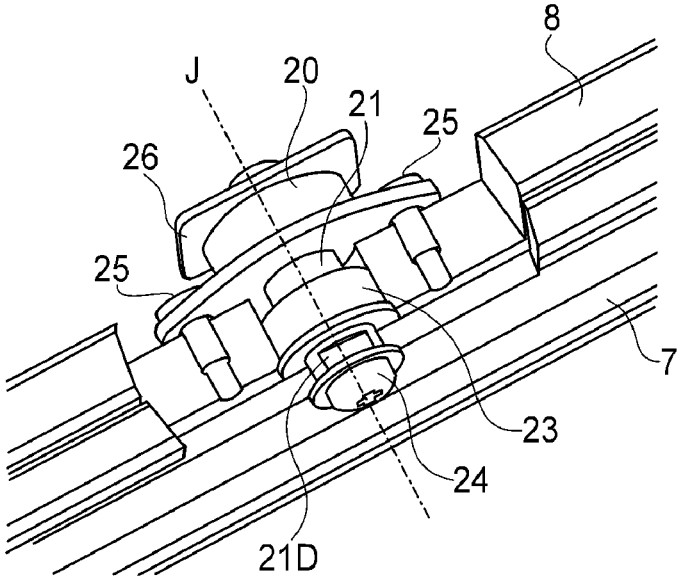
FIG. 4 is a detailed view of the center portion of the belt centering automatic mechanism in the first embodiment of the present invention.

FIG. 4 is a sectional view of the center portion of the belt centering mechanism supporting plate, and shows the structure thereof. The center portion of the rotational plate 7 is fitted with a steering shaft 21, which is integrally connected to the rotational plate 7 with small screws. The steering shaft 21 is a rotational shaft, and one of its lengthwise end portions of the steering shaft 21 is "chamfered" in such a manner that it is provided with a pair of flat surfaces which are parallel to each other and oppose each other across the axis of the shaft 21. The steering shaft 21 is put through a bearing 23 of the frame stay 8, being thereby supported by the frame stay 8 (bearing 23). The steering shaft 21 functions also as a center shaft of the rotary damper 20. The other end of the steering shaft 21 is fitted with a stopper 26 for preventing the rotary damper 20 from being made to slip off the steering shaft 21 by thrust. The rotary damper 20 is solidly attached to the frame stay 8 with a pair of small screws 25. The rotary damper 20 in this embodiment is a resistance (friction) generating means which uses viscosity of oil or the like as the resistance (friction) generating source. Thus, the amount of resistance which the rotary damper 20 generates between the rotational damper 20 and the steering shaft 20 as the steering shaft 21 is rotationally moved is proportional (theoretically) to the shear rate of the steering shaft 21. That is, as the steering shaft 21 increases in the rate of change of its angle per unit length of time, the force which works against the tilting of the steering shaft 21 also increases.

Figure 5:
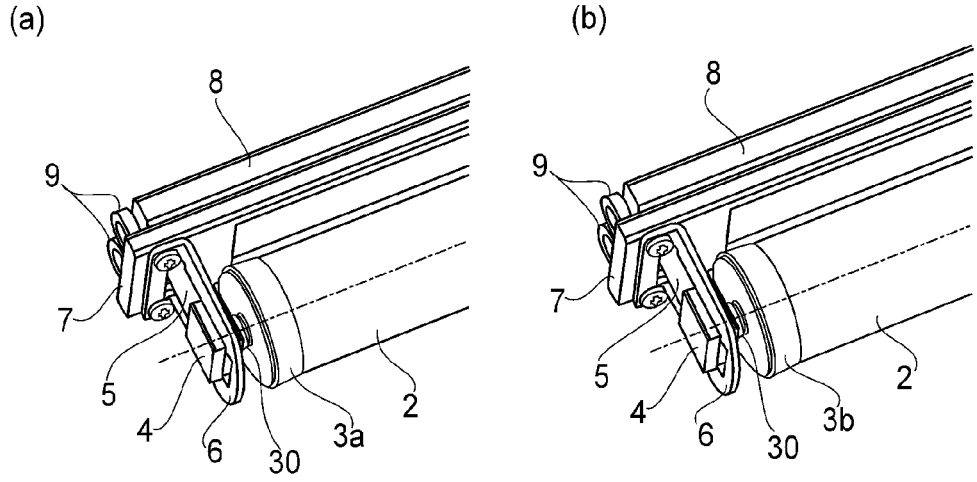
FIGS. 5(*a*) and 5(*b*) are detailed views of one of the end portions of the belt centering automatic mechanism in the first embodiment of the present invention.

FIGS. 5(*a*) and 5(*b*) are detailed drawings of one of the lengthwise end portions of the belt centering automatic mechanism.

Each of the pair of friction rings 3 is shaped like a friction rings 3*a*, shown in FIG. 5(*a*), which is uniform in external diameter (straight type) in terms of the direction parallel to the steering member shaft, or a ring 3*b*, shown in FIG. 5(*b*), which is not uniform in external diameter in terms of the direction parallel to the steering member shaft 30, that is, which is tapered (tapered type) in such a manner that the outward end, in terms of the direction parallel to the lengthwise direction of the steering member shaft 30 is greater in external diameter than the inward end. The roller 2 is rotatably supported by the steering member shaft 30; the roller 2 has a pair of internal bearings, through which the steering member shaft 30 is put, so that the roller 2 is allowed to be rotated by the rotation of the intermediary transfer belt 606. The pair of friction rings 3 (3*a* or 3*b*), located at the lengthwise ends of the roller 2, also are supported by the steering member shaft 30, but not in a rotatable manner. They are prevented from rotating by parallel pins or the like. The steering member shaft 30 is nonrotationally supported by the slide bearings 4; each of the lengthwise end portions of the steering member shaft 30 is shaped so that it is D-shaped in cross section. Thus, as the intermediary transfer belt 606 is driven, it does not slide (rub) on the roller 2 of the steering member 1. However, it slides (rubs) on the friction rings 3 (3*a* or 3*b*) which are at the lengthwise ends of the roller 2. The principle on which the belt centering automatic system (mechanism) structured as described above works is as described previously with reference to Equations (1)-(6). That is, in this embodiment, the area of contact between one of the friction ring 3 and intermediary transfer belt 606 becomes greater in size than a preset value, the steering member 1 begins to steer the intermediary transfer belt 606. Incidentally, the belt centering automatic mechanism in this embodiment is structured so that the friction rings 3 remain stationary; the friction rings 3 do not rotate in the direction in which the roller 2 is rotated. However, it does not need to be structured as described above. That is, it may be structured so that the friction rings 3 are rotatable. In such a case, however, it has be structured so that the amount of torque necessary to rotate the friction rings 3 in the same direction as the direction in which the intermediary transfer belt 606 is rotated is greater than the amount of torque necessary to rotate the roller 2 of the steering member 1, because as long as the former is greater than the latter, the intermediary transfer belt 606 can be steered.

Figure 8:
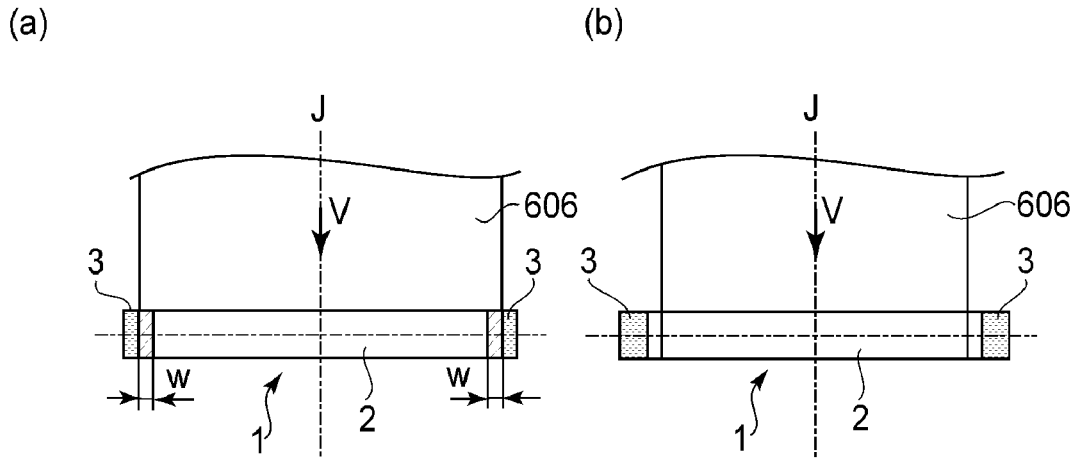
FIGS. 8(*a*) and 8(*b*) are graphs for describing the relationship between the belt and friction ring, in terms of the width of the area of contact between the belt and friction ring.

Also in this embodiment, the width of the intermediary transfer belt 606 is more than that of the roller 2, and is less than that of the steering member 1 (roller 2+two friction rings 3 located at lengthwise ends, respectively, of roller 2). Thus, when the intermediary transfer belt 606 is remaining ideally positioned (centered), the relationship between the intermediary transfer belt 606 and friction rings 3 in terms of area of contact is as shown in FIG. 8(*a*). That is, the width w (hatched portions in drawings) of the abovementioned area of contact at one lengthwise end of the steering member 1 is the same as that at the other lengthwise end. Therefore, it is ensured that even if the intermediary transfer belt 606 deviates in position, the intermediary transfer belt 606 remains in contact with one of the friction rings 3, sliding thereon, while being driven. In other words, in this case, the belt 606 always slides on one or both of the friction rings 3 while being driven. This structural arrangement is made for the following reason. That is, in a case where the intermediary transfer belt 606 is narrower than the roller 2 as shown in FIG. 8(*b*), even if the intermediary transfer belt 606 deviates, the supporting plate does not rotate until the belt 606 overlaps with one of the friction rings 3. Therefore, the steering member 1 is likely to abruptly begin to center the belt 606. However, even if the relationship between the width of the belt 606 and roller 2 is as shown in FIG. 8(*b*), it is possible to automatically keep the belt 606 by utilizing the difference between the lengthwise end portions of the steering member 1 in terms of the amount of the friction between the belt 606 and friction ring 3. However, a setup such as the one shown in FIG. 8(*a*), in which the difference between the lengthwise end portions of the steering member 1 in terms of the amount of friction between the belt 606 and friction ring 3 can be always detected, and therefore, it makes the belt centering automatic mechanism respond to belt deviation in a much earlier stage of the deviation than the setup shown in FIG. 8(*b*). Therefore, it does not cause the steering member 1 to excessively change in angle.

Next, the coefficient μs of static friction of the friction rings 3*a* will be described.

Concretely describing, in a case where the friction rings 3 in this embodiment are tapered as shown in FIG. 5(*b*), the coefficient μs of the friction ring is roughly 0.3 (μs≈0.3), and the angle (ϕ) of taper is 8°: ϕ=8°, in this embodiment.

Further, it is assumed that the coefficient of friction of the peripheral surface of each friction ring 3 is greater than that of the peripheral surface of the roller 2. The material of the friction ring 3*a* is resinous substance, such as polyacetal (POM), which is relatively slippery. Further, in consideration of the electrostatic problem attributable to the electricity generated by the friction between the friction rings 3*a* and intermediary transfer belt 606, the material for the friction ring 3*a* is made electrically conductive. Incidentally, in a case where the friction rings 3 are shaped as shown in FIG. 5(*a*), that is, they are uniform in diameter, it is desired that μs≈0.6; μs is desired to be greater than in a case where the friction rings 3 are tapered.

Next, the coefficient $\mu_{STR}$ of static friction of the roller 2 will be described. The roller 2 is formed of aluminum. Its peripheral surface is made to be roughly 0.1 in coefficient $\mu_{STR}$ of static friction; $\mu_{STR} \approx 0.1$. That is, it is made lower than the coefficient μs of friction of the friction rings 3.

The substrate layer of the intermediary transfer belt 606 is made of polyimide, and is roughly 18,000 N/cm$^2$ in coefficient of tensional elasticity (E): E≈18,000 N/cm$^2$. A large amount of tensional stress, which occurs in a substance which is large in coefficient of tensional elasticity E, can be efficiently converted into the belt centering force, by reducing the roller 2 in coefficient μs of friction.

At the same time, because the distortion which occurs to the intermediary transfer belt 606 is continuously released, it does not occur that the intermediary transfer belt 606 is driven while remaining subjected to the excessive amount of load.

Therefore, not only is the intermediary transfer belt 606 automatically centered, but also, it is prevented from breaking or suffering from the like problems. Incidentally, it is not mandatory that the material for the substrate layer of the intermediary transfer belt 606 is polyimide. It may be a resinous substance other than polyimide, or a metallic substance, as long as the substance is similar in coefficient of tensional elasticity to polyimide, and is unlikely to easily stretch. Further, the material for the roller 2 may be a substance other than aluminum, as long as the substance can meet the following requirement: it prevents the problem that $\mu_{STR} \leqq \mu$.

At this time, the method for measuring the coefficient of friction of the friction ring 3, roller 2, driving roller, etc., described above, will be described. The coefficients of friction of the components of the belt steering automatic mechanism in this embodiment were measured with the use of the method for testing coefficient of plastic film and sheet (JIS K7125). More concretely, a piece of the inward layer of the intermediary transfer belt 606, which in this embodiment is made of polyimide, is used as a test piece.

Figure 16:
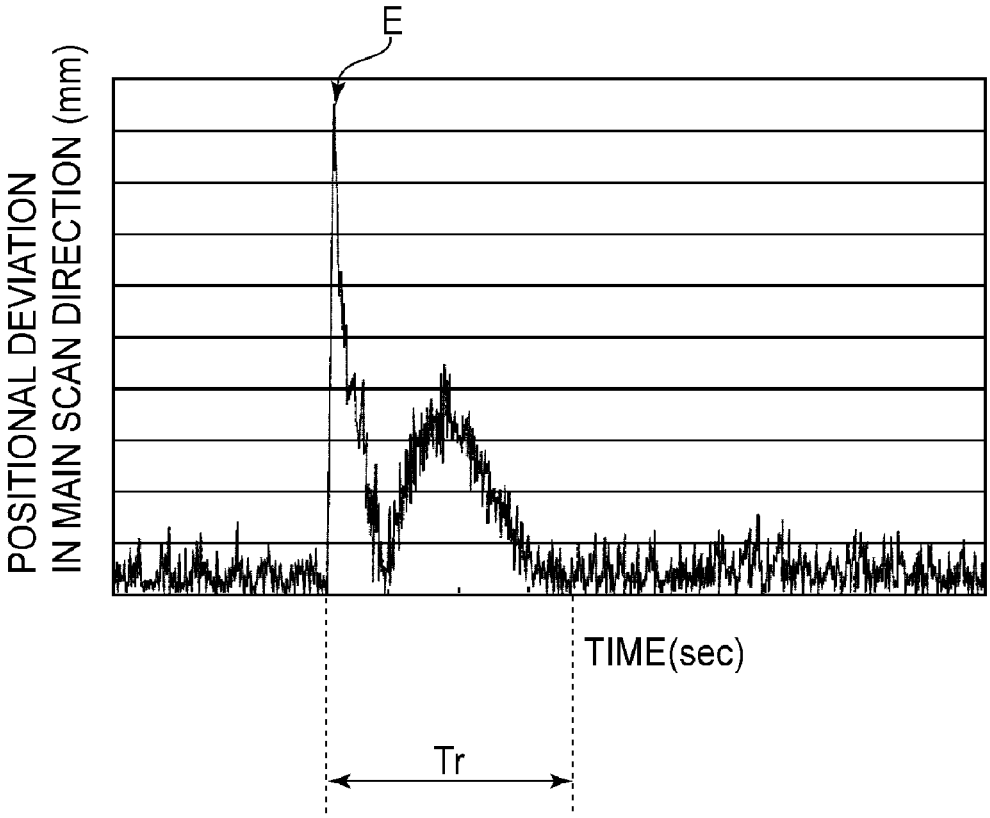
FIG. 16 is a graph which shows the problem which a conventional belt centering automatic mechanism has.
Figure 17:
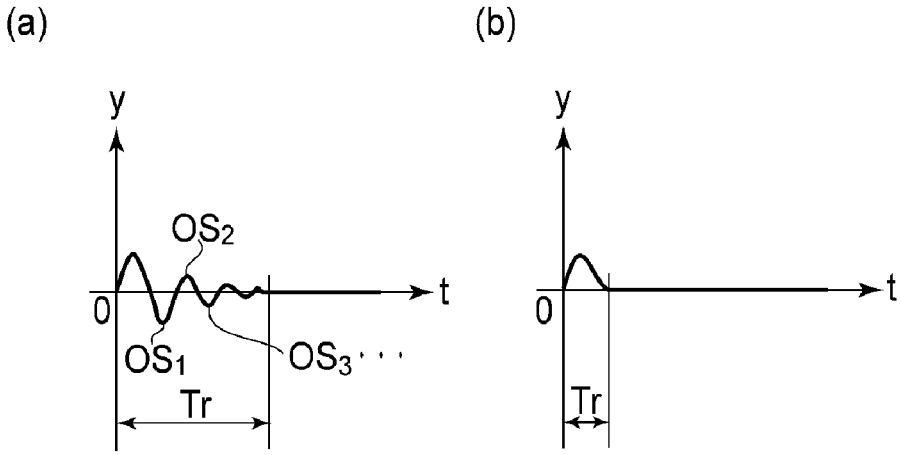
FIG. 17 is a graph which shows the relationship between the belt edge position and the length of elapsed time.

Next, the rotary damper 20 will be described. Referring to FIG. 4, the dumber 20 in this embodiment is a rotary damper. It uses viscous resistance. Therefore, the amount of the resistance R which the rotary damper 20 generates is proportional to the rate of change (dβ/dt), per unit length of time, of the steering angle (that is, steering speed). In the case of the structural arrangement for the belt centering automatic mechanism in this embodiment, the rate (dβ/dt) of change of steering angle per unit length of time and the amount of resistance R are proportional to each other. The belt centering automatic system which uses the difference in the friction between one of the lengthwise ends of the steering member 1*d* and the other is different from the belt centering automatic mechanism which uses an actuator, in that the former has a characteristic feature that it is very long (roughly 60 seconds) in belt centering cycle, that is, it is very low in steering speed (dβ/dt). In particular, in the case of a belt centering automatic mechanism (system) structured as described with reference to FIG. 8(*a*), a normal range for the belt steering speed, that is, the range exclusive of the portion which corresponds to the timing of the sudden occurrence of a large amount of external disturbance, is very small, for example, range $A_N$ shown in FIG. 7(*b*). However, as the belt centering automatic mechanism (image forming apparatus 30) is subjected to a problematic external disturbance, that is, a large amount of external disturbance, the steering speed becomes relatively high (range $A_E$). That is, while the intermediary transfer belt 606 is automatically centered under the normal condition, that is, when the image forming apparatus is not suddenly subjected to a substantial amount of external disturbance, only a very small amount of resistance R occurs. Therefore, the resistance R does not interfere with the belt centering operation. On the other hand, as the belt centering automatic mechanism (image forming apparatus 60) is suddenly subjected to a substantial external disturbance, a large amount of resistance R is generated, minimizing thereby the effect of the disturbance upon the steering member 1. Consequently, the intermediary transfer belt 606 is prevented from be suddenly made to change in attitude by the external disturbance. In other words, the intermediary transfer belt 606 does not suddenly deviates in position in the primary scan direction as much as shown in FIG. 16, and therefore, the length Tr of time the intermediary transfer belt 606 is made to deviate by the sudden external disturbance not last as shown in FIG. 16.

Figure 7:
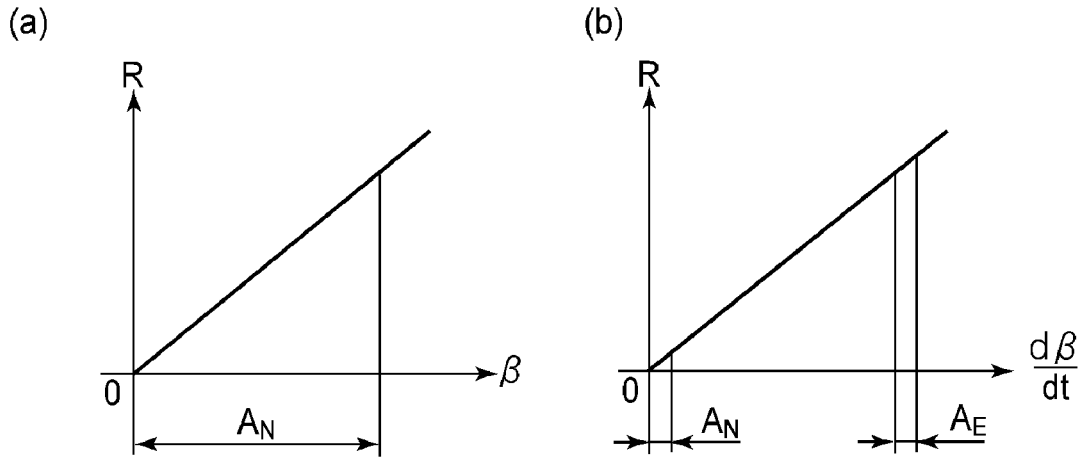
FIGS. 7(*a*) and 7(*b*) are graphs for describing the characteristic properties of the resistance (friction) generating means.

Further, even in terms of the evaluation of the belt centering automatic mechanism from the standpoint of control, the belt edge movement in the direction y quickly returns to the normal range, without overshooting, as shown in FIG. 7(*b*).

The present invention is related to the improvement of a belt centering automatic mechanism in terms of responsiveness. Therefore, it is reasonable to think that the present invention is applicable to a wide range of belt driving apparatuses, regardless of the presence of an image forming apparatus. For example, in the case of the fixing apparatus 68 shown in FIG. 1, the portion of the fixing apparatus 68, which drives the fixation belt 614, is a belt driving apparatus to which the present invention is applicable. Therefore, the same effects as those described above can be obtained by equipping one of the rollers which support and keep stretched the fixation belt 614, with the belt centering automatic mechanism (structured as shown in FIG. 3, or in similar manner).

<Characteristic Features of Belt Centering Automatic Mechanism, and Tuning of Mechanism in Torque>

Figure 6:
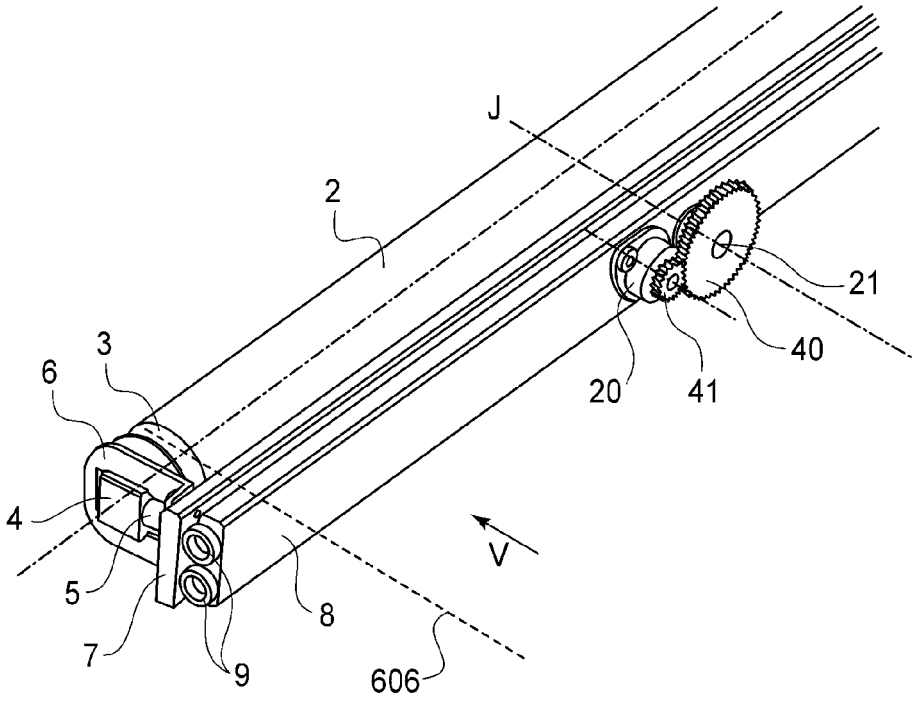
FIG. 6 is a perspective view (2) of the belt centering automatic mechanism in the first embodiment of the present invention.

In this embodiment, the belt centering automatic mechanism has to be adjusted (tuned) in belt centering property, and in the torque of the rotary damper 20. The material of the intermediary transfer belt 606 is polyimide, or the like, which is relatively high in elasticity. Therefore, it is limited in the steering range in which the belt can be automatically centered by the resistance attributable to the tensional stress of the belt itself. In this embodiment, the range is roughly ±2°. However, the overall length of the steering member 1 is roughly 370 mm, which is relatively long. Therefore, the range of the positional deviation of the intermediary transfer belt 606, in terms of the movement of its lengthwise ends, is roughly 13 mm, which is sufficient. That is, in the case of a structural arrangement for a belt centering automatic mechanism which directly uses the steering speed dβ/dt of the steering shaft 21 as shown in FIGS. 3 and 4, even when the mechanism is suddenly subjected to a large amount of external disturbance, the steering speed dβ/dt remains relatively small relative to the torque of the rotary damper 20. Therefore, it is thinkable that a desired amount of resistance R cannot be obtained within the range of the play of the damper 20. In such a case, the amount by which the rotary damper 20 generates the resistance R can be adjusted by employing a structural arrangement, such as the one shown in FIG. 6, which utilizes gears (gear ratio). FIG. 6 is a perspective view of the belt centering automatic mechanism in this embodiment, as seen from the opposite direction from the direction in which the mechanism is seen in FIG. 3. The intermediary transfer belt 606 is driven in the direction indicated by the arrow mark V in the drawing. The belt centering automatic mechanism shown in FIG. 6 is the same in structure as that in FIG. 3, except for the portions next to the steering shaft axis J. Thus, only the portions of the belt centering automatic mechanism in FIG. 6, which are different from the corresponding portions of the belt centering automatic mechanism in FIG. 3, will be described here. The belt centering automatic mechanism shown in FIG. 6 is provided with a steering gear 40, which is attached to one of the lengthwise ends of the steering shaft 21 in such a manner that its rotational axis coincides with the steering shaft axis J, and also, so that it rotates with the steering shaft 21. The number of the teeth of the steering gear 40 is Z1. The mechanism is also provided with a damper gear 41 which is in mesh with the steering gear 40. The number of the teeth of the damper gear 41 is Z2. The damper gear 41 is rotatably fitted around the rotational shaft (center shaft) of the rotary damper 20. The relationship in terms of teeth count between the two gears is: Z1>Z2. Thus, the rotational shaft of the rotary damper 20 is rotated faster than the steering shaft.

Therefore, even if the steering speed dβ/dt is low, the amount by which the resistance R is generated by the rotary damper 20 can be increased by adjusting the gear ratio between the gears 40 and 41 in accordance with the belt centering property of the belt centering automatic mechanism. Further, this method uses the pair of gears to adjust the amount by which the damper 20 can provide resistance. Therefore, the employment of the structural arrangement shown in FIG. 6 can provide a belt centering automatic mechanism which is significantly smaller in size and lower in cost than a belt centering automatic mechanism which uses a belt centering automatic mechanism which employs a rotary damper, the resistance which it provides being adjustable in amount by increasing the coefficient of viscosity of the fluid in the damper.

As described above, the employment of this embodiment can provide a belt centering automatic mechanism with such a resistance that is effective to only a sudden and large amount of external disturbance, and yet, does not interfere with the normal belt centering function. In other words, it can minimize the weakness of a conventional belt centering automatic mechanism. Therefore, it can provide a belt driving apparatus, the steering shaft of which is significantly more shock resistant, and which is significantly less likely to suffer from sudden change in attitude of its belt, and consequential misalignment of monochromatic images in terms of the primary scan direction, than any of the conventional belt driving apparatuses. In particular, the application of this embodiment to an intermediary transfer belt unit, and an image forming apparatus having an intermediary transfer belt can solve the two problems, that is, poor image quality and belt deviation, while reducing the apparatus in cost.

Embodiment 2

Figure 9:
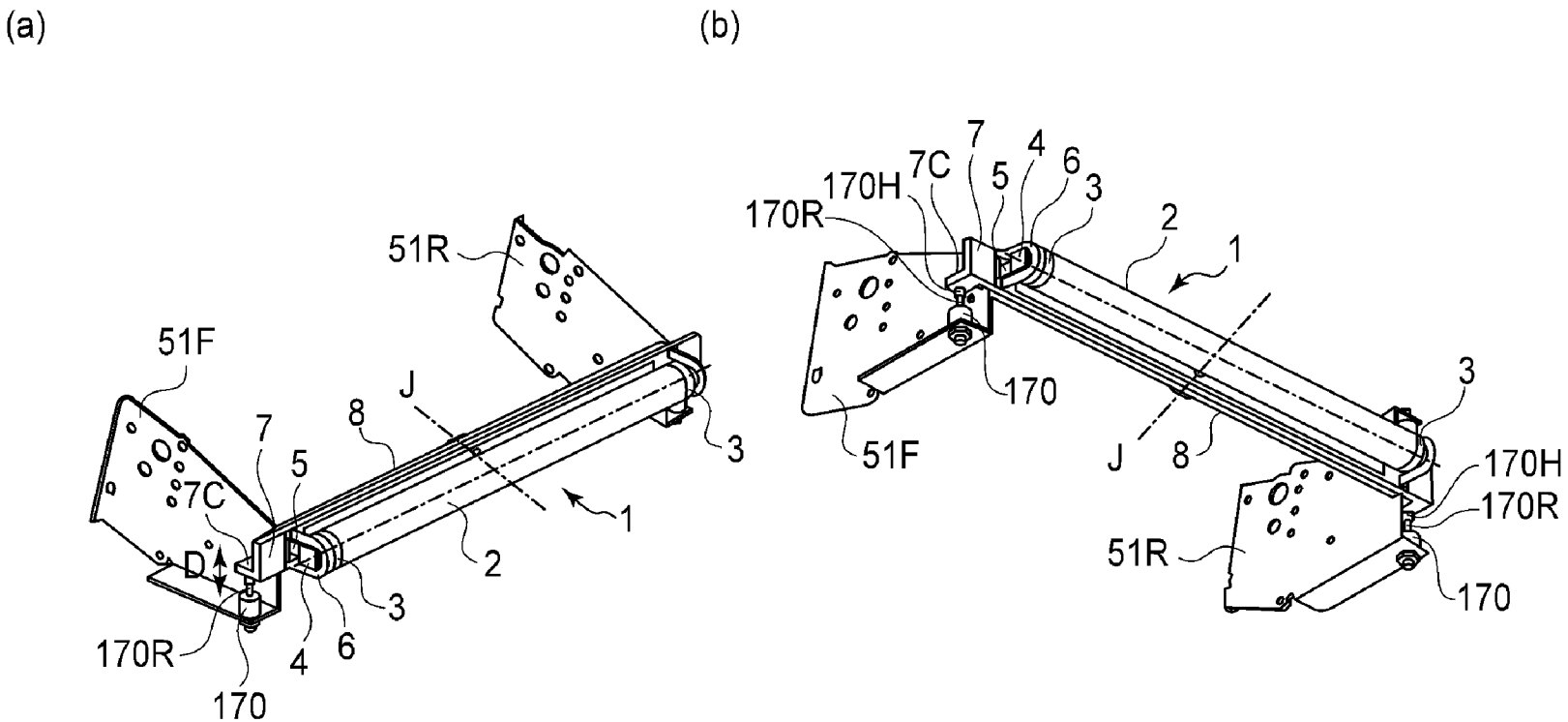
FIGS. 9(*a*) and 9(*b*) are perspective views of the belt centering automatic mechanism in the second embodiment of the present invention.

FIGS. 9(*a*) and 9(*b*) are perspective views of the belt centering automatic mechanism in the second embodiment of the present invention. More specifically, they are perspective views of the essential portions of the belt centering automatic mechanism of the intermediary transfer belt unit 50 (FIG. 2) which the image forming apparatus 60 shown in FIG. 1 has. FIG. 9(*a*) is a perspective view of the belt centering automatic mechanism as seen from the top side, whereas FIG. 9(*b*) is a perspective view of the belt centering automatic mechanism as seen from the bottom side. The portion of the belt centering automatic mechanism shown in FIGS. 9(*a*) and 9(*b*) correspond to the portion of the belt centering automatic mechanism shown in FIG. 3. The structure and operation of the image forming apparatus 60, and the structure and operation of the intermediary transfer belt unit 50, will not be described here. Further, the steering member 1 in this embodiment also is made up a rotatable portion 2 (roller 2), and a pair of stationary friction rings 3, as shown in FIGS. 3-5. The roller 2 rotates following the rotational movement of the intermediary transfer belt 606, whereas the pair of stationary rings doe not rotate following the rotational movement of the intermediary transfer belt 606. Further, the structure of this belt centering automatic mechanism is basically the same as that of the belt centering automatic mechanism in the first embodiment, in that the slidable bearings 4 are under the pressure from the tension springs, and the steering member 1 doubles as a tension roller, as shown in FIGS. 3-5. The two belt centering automatic mechanisms are also basically the same in that they are structured so that the rotational plate 7, as a supporting plate, is allowed to rotated relative to the frame stay 8 which is between the front and rear plates 51F and 51R, respectively, of the intermediary transfer intermediary transfer belt unit 50, about the steering shaft axis J, as shown in FIGS. 3-5. The difference between the portion of the belt centering automatic mechanism shown in FIG. 9, from that shown in FIGS. 3-5, is that the former uses a direct damper 170 (so-called shock absorber), as a resistance generating means, the rod 170R of which moves in the direction indicated by an arrow mark D in the drawing. Referring to FIG. 9, two direction damper 170 are used, which are at the lengthwise ends of the supporting plate 7, one for one; each damper 170 is attached to a small plate formed by perpendicularly bending a part of the front plate 51F, or rear plate 51R, of the unit 50. That is, the direct dampers 170 are positioned a preset distance (optional) away from the rotational axis of the steering member 1. Further, the outward end of the rod 170R of each direct damper 170 is semispherical, forming a damper head 170H, which is always in contact with the contact area 7C of the rotational plate 7. It is desired that when steering angle β is zero (β=0), the two rods 170R are in their neutral positions. The reason why the damper head 170H is made semispherical is that the direction in which the point of contact between the damper head 170H and contact area 170C is made to shift by the belt centering action remains parallel to the tangential line to the damper head 170H at the point of contact, and therefore, the belt is smoothly centered.

The direct damper 170 also is a resistance generating means which uses the viscous resistance of oil or the like, as does the rotary damper 20 in the first embodiment. Therefore, the amount of resistance R it generates is proportional (theoretically) to the steering speed dβ/dt, as shown in FIG. 7(*b*). That is, the resistance R increases in proportion to the speed of the point of contact between the damper head 170H and area of contact 7C. In the case of this embodiment, however, because of the overall length of the steering member 1, the rod 170R of the direct damper 170 sufficiently displaces even if the steering angle range is very small, as the lengthwise ends of the supporting plate 7 in the first embodiment described above does, which is one of the characteristic features of this embodiment. More concretely, if the steering angle range is roughly ±2°, and the overall length of the steering member 1 is roughly 380 mm, the maximum amount of the displacement of the rod 170R of each damper 170 is roughly 6.5 mm. In other words, the belt centering automatic mechanism in this embodiment is easier to tune (adjust) in terms of belt centering property and resistance. Incidentally, the belt centering automatic mechanism in this embodiment is provided with two direct dampers 170, which are located at the lengthwise ends of the rotational plate 7, one for one, as shown in FIG. 9. However, the dampers 170 may be disposed so that they sandwich one of the lengthwise end portions of the rotational plate 7 from the top and under sides.

As described above, the usage of this embodiment can also provide a belt centering automatic mechanism which resists only a large amount of sudden external disturbance, that is, which does not interferes with the normal belt centering operation. In other words, it can minimize the weakness of a conventional belt centering automatic mechanism, that is, excessive sensitivity of the steering shaft to a large amount of sudden external disturbance. Thus, it can provide a belt driving apparatus which is significantly less likely to suddenly change the belt in attitude, and therefore, is significantly less in the amount of the misalignment of monochromatic images, different in color, in the primary scan direction, which is attributable to the sudden change of the belt attitude, than any of the conventional belt driving apparatus.

Embodiment 3

Figure 10:
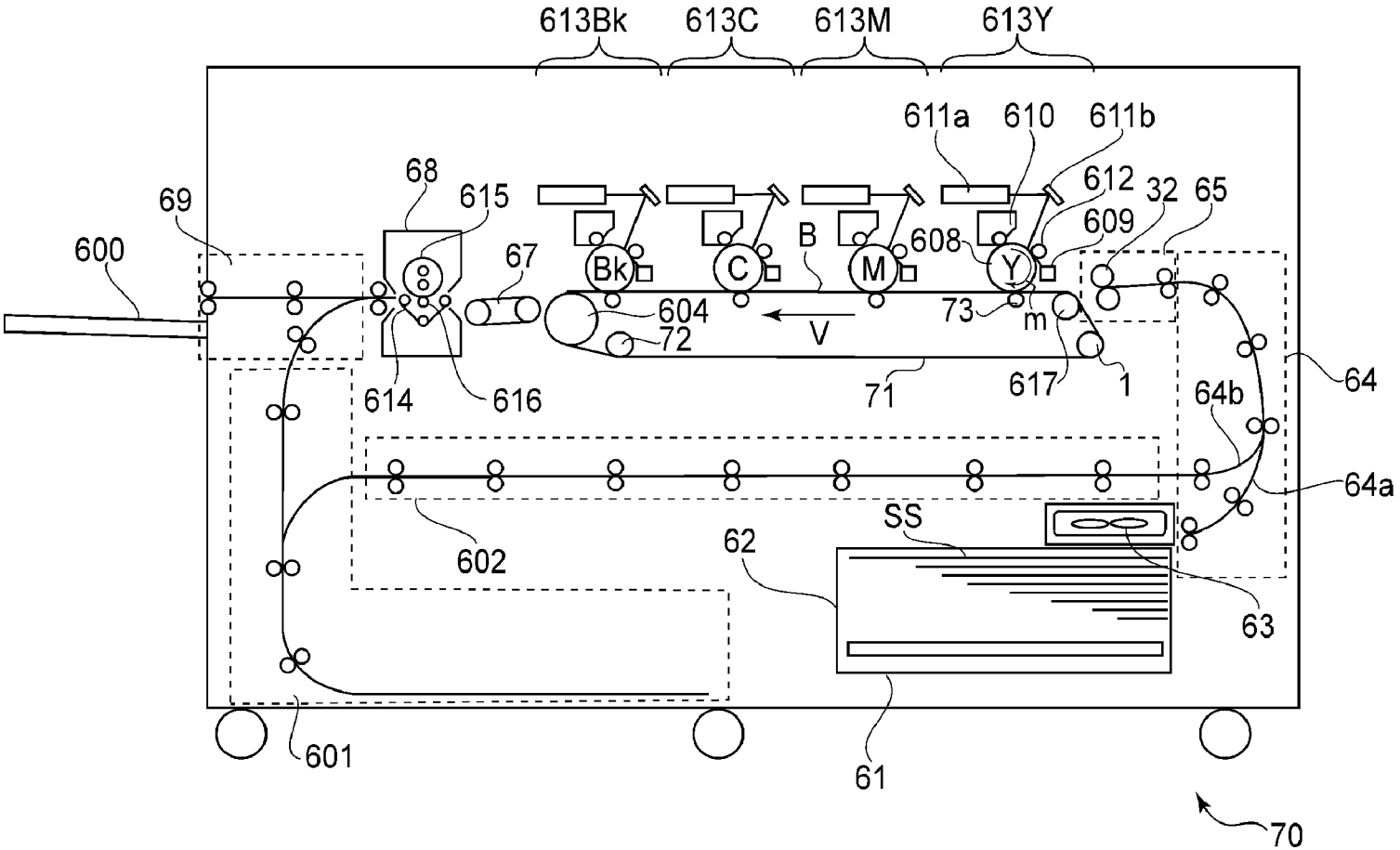
FIG. 10 is a sectional view of the image forming apparatus in the third embodiment of the present invention.

The first and second embodiments described above were related to the intermediary transfer intermediary transfer belt unit 50, and the image forming apparatus 60 which has the intermediary transfer intermediary transfer belt unit 50. This embodiment is related to a belt involved in image formation other than the belts in the first and second embodiments. More specifically, this embodiment is related to the direct transfer belt 71, with which the image forming apparatus 70 shown in FIG. 10 is provided. Basically, the image forming apparatus 70 shown in FIG. 10 is similar in the feeding (process) of transfer medium and the conveying of recording medium. Therefore, only the image formation process of the image forming apparatus 70, which is different from that of the image forming apparatus 60 in the first embodiment, will be described.

The image forming portion 613 is made up of primarily: a photosensitive member 608; a charging device 612; an exposing apparatus 611*a*; a developing apparatus 610; a transferring apparatus 73; and a photosensitive member cleaner 609. The photosensitive member 608 is rotated in the direction indicated by an arrow mark m in the drawing. As the photosensitive member 608 is rotated, its peripheral surface is uniformly charged by the charging device 612. The charged portion of the peripheral surface of the photosensitive member 608 is exposed by the exposing apparatus 611*a*. More specifically, as the exposing apparatus 611*a* is driven, a beam of light is projected from the exposing apparatus 611*a* while being modulated with the inputted signals which reflect the information of the image to be formed. This beam of light is deflected by the beam deflecting means 611*b*, etc., so that it scans the charged area of the peripheral surface of the photosensitive member 608. As a result, an electrostatic latent image is effected upon the peripheral surface of the photosensitive member 608. Then, the electrostatic latent image is developed by the developing apparatus 610 which uses toner. As a result, a visible image is formed of toner (yellow toner, in this case), on the peripheral surface of the photosensitive member 608 (visible image will be referred to as toner image, hereafter). Meanwhile, the recording sheet S is released by a pair of registration roller 32 in synchronism with the formation of the yellow toner image in the most upstream image forming portion 613 (613Y). Then, the recording sheet S is held to the recording sheet holding surface of the direct transfer belt 71 by the static electricity or the like, and is conveyed further by the direct transfer belt 71. As the recording sheet S is conveyed by the direct transfer belt 71, the toner image on the photosensitive member 608 is transferred onto the recording sheet S by the pressure and electrostatic bias (load) applied by the transferring apparatus 73. The image forming and transferring operations similar to the one described above are carried out, sequentially and partially overlapping manner, in the downstream image forming portions, that is, the magenta (M), cyan (C), and black (BK) image forming portions. Then, the images are sequentially transferred onto the recording sheet S on the direct transfer belt 71 which is being driven, with such timings that the images formed in the downstream image forming portions are layered upon the images formed and transferred in the upstream image forming portions. Consequentially, a full-color toner image is effected on the recording sheet S. Then, the recording sheet S is separated from the direct transfer belt 71, and is conveyed to the fixing apparatus 68 by the recording sheet conveying portion 67, which is between the recording sheet separating portion and the fixing apparatus 68. The transfer residual toner, that is, a small amount of toner remaining on the peripheral surface of the photosensitive member 608 after the direct transfer, is recovered by the photosensitive member cleaner 613 to prepare the photosensitive member 608 for the next image formation. In the case of the image forming apparatus shown in FIG. 10, it has four image forming portions 613, more specifically, image forming portions 613Y, 613M, 613C, and 613BK. However, the number of color toners of which a full-color image is formed, and the order in which monochromatic toner images, different in color, are formed, does not need to be limited to the above described one.

Next, the direct transfer belt unit, which is a belt driving unit for driving the direct transfer belt 71, will be described about its structure. The direct transfer belt 71 is suspended and kept stretched by a driver roller 604, steering member 1, and a pair of follower rollers 72 and 617, and is driven in the direction indicated by an arrow mark V in the drawing. The follower rollers 72 and 617 are allowed to freely rotate, and rotate following the rotation of the direct transfer belt 71. The steering member 1 doubles as a tension roller for providing the direct transfer belt 71 with a preset amount of tension.

The structural arrangement for supporting the steering member 1 in this embodiment is the same as that of the belt centering automatic mechanism described above with reference to FIGS. 3 and 4. In the case of the image forming apparatus 70, shown in FIG. 10, in which images formed on the photosensitive members 608 are directly transferred onto the recording sheet S, the change in the attitude of the direct transfer belt 71 is the same in effect as the change in the attitude of the recording sheet S. Therefore, as the image forming apparatus 70 is subjected to a large amount of sudden external disturbance, its belt centering automatic mechanism is likely to excessively respond to the disturbance, being therefore likely to cause the direct transfer belt 70 to deviate in the primary scan direction in the similar manner to the belts shown in FIG. 16, unless it is provided with a means for minimizing the effects of the disturbance. Thus, the above described problems can be solved by employing the belt driving unit having the belt centering automatic mechanism in this embodiment of the present invention, which has a means for increasing the resistance of the steering member 1 against a large amount of sudden external disturbance in proportion to the steering speed $d\beta/dt$.

Incidentally, the image forming portion 613 in this embodiment, which is shown in FIG. 10, uses an electrophotographic image forming method. However, it can be replaced with an image forming portion which uses an inkjet image forming method.

Embodiment 4

Figure 11:
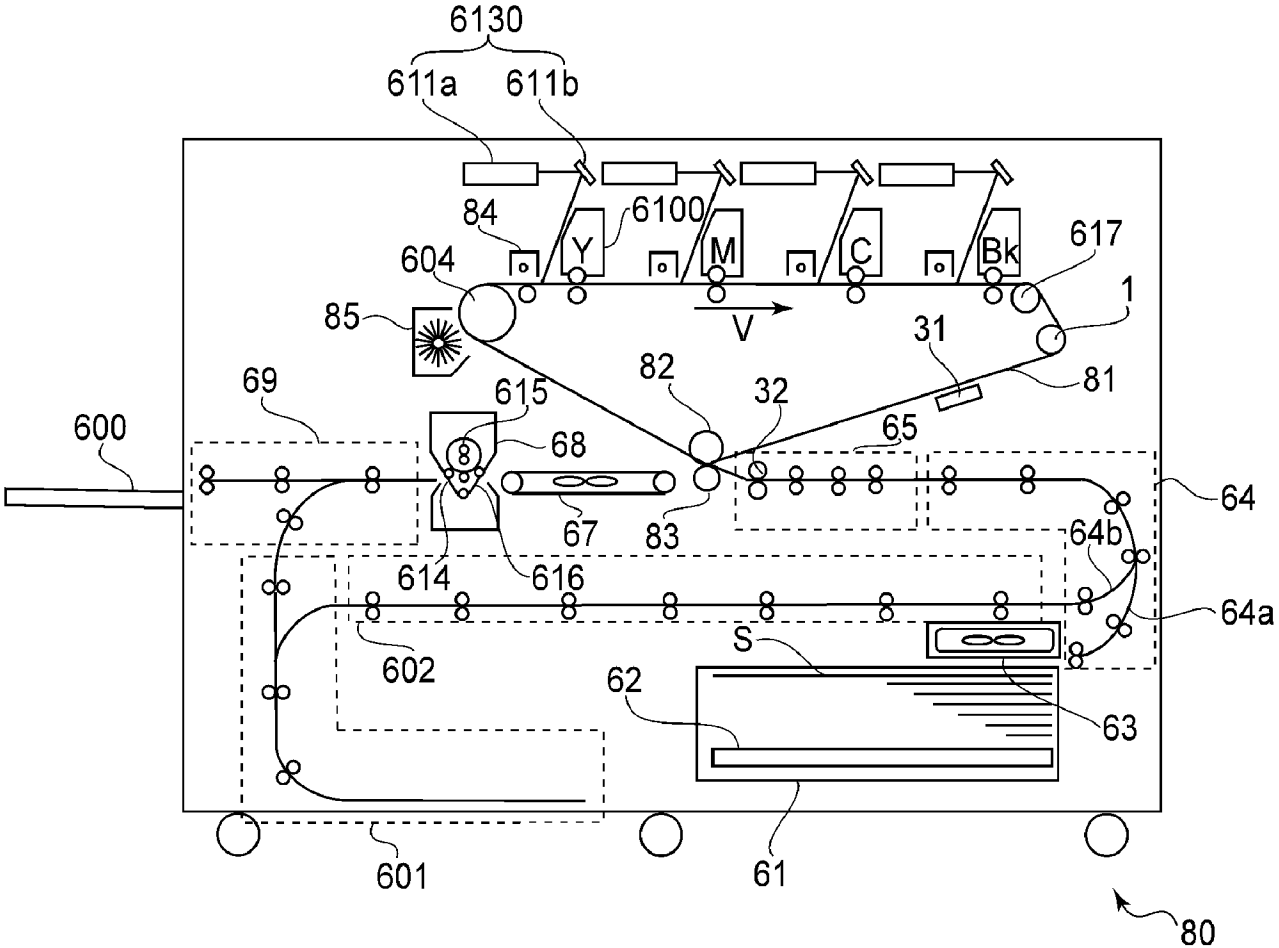
FIG. 11 is a sectional view of the image forming apparatus in the fourth embodiment of the present invention.
Figure 12:
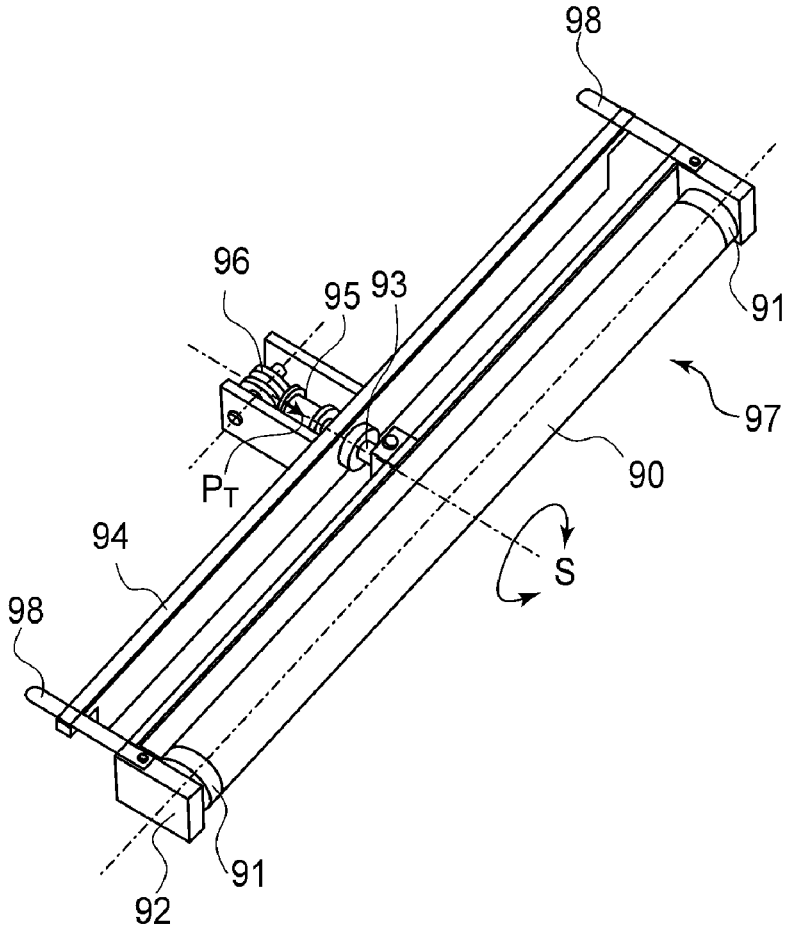
FIG. 12 is a perspective view of a typical conventional belt centering automatic mechanism.
Figure 13:
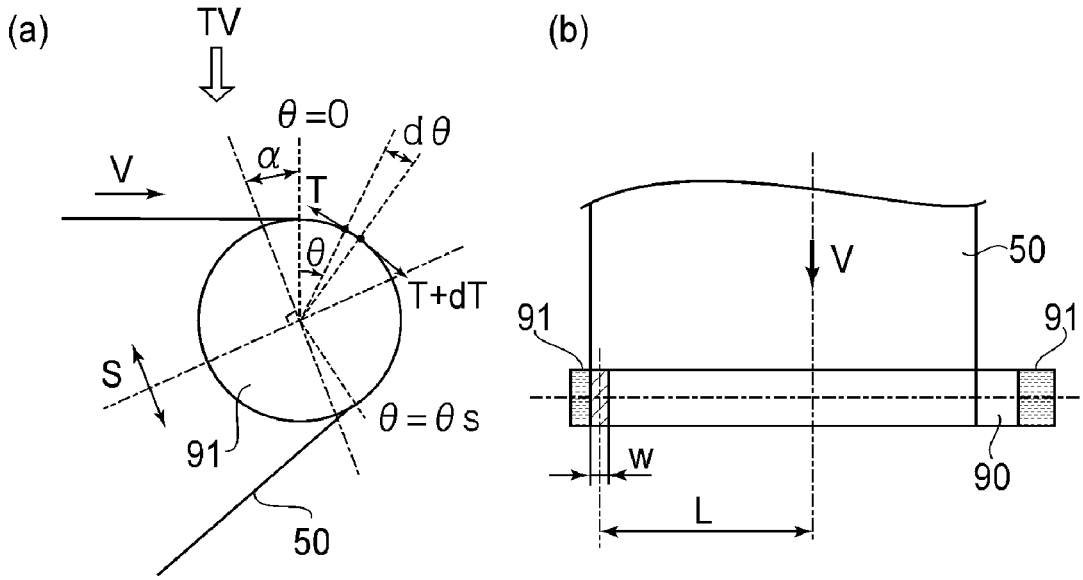
FIGS. 13(*a*) and 13(*b*) are drawings for describing the principle on which the belt centering automatic mechanism is based.
Figure 14:
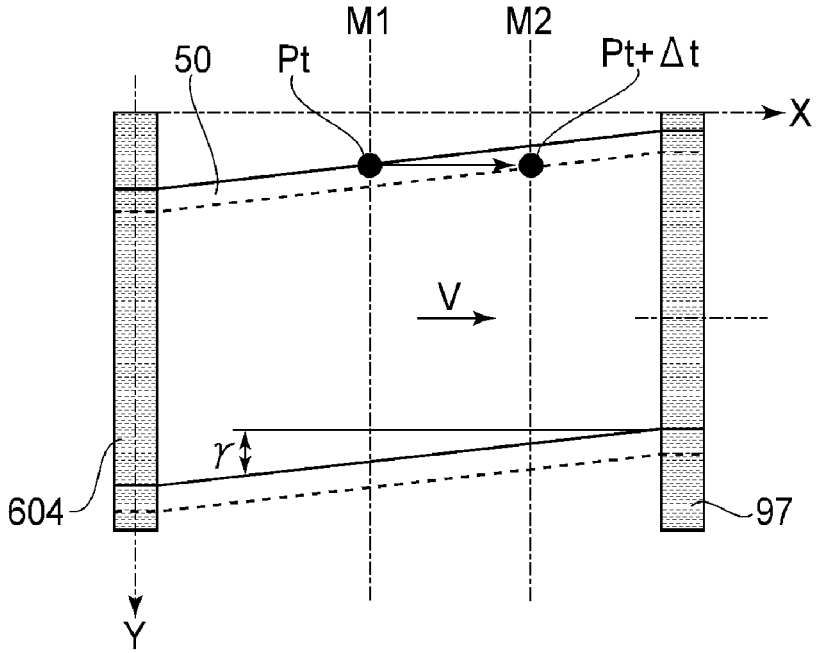
FIG. 14 is a drawing (1) for describing the relationship between the positional deviation of the intermediary transfer belt and the misalignment of the monochromatic images, different in color, in terms of the primary scan direction.
Figure 15:
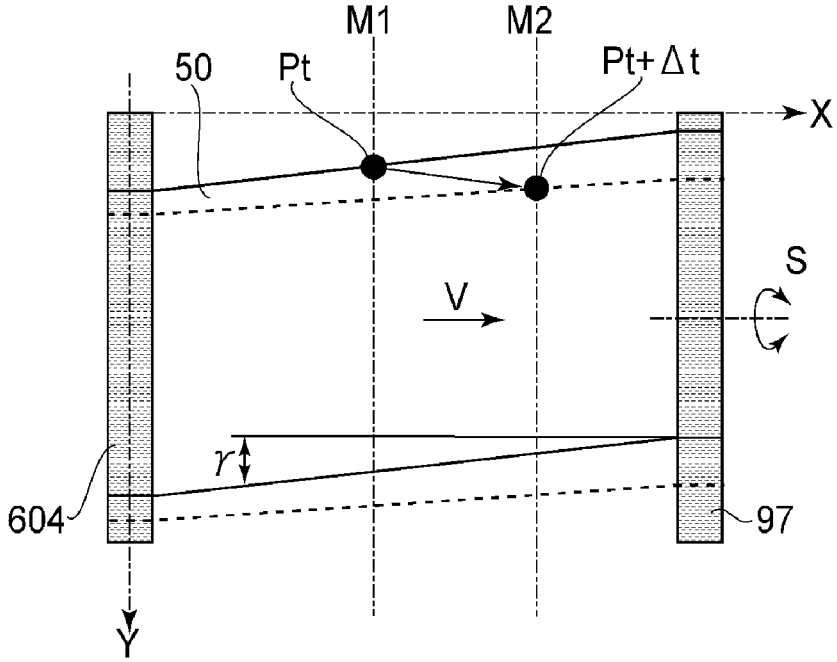
FIG. 15 is a drawing (2) for describing the relationship between the positional deviation of the intermediary transfer belt and the misalignment of the monochromatic images, different in color, in terms of the primary scan direction.

The belt involved in image formation in this embodiment is a photosensitive belt 81 with which the image forming apparatus 80 is provided. Basically, the image forming apparatus 80 shown in FIG. 11 is similar in the feeding (process) of transfer medium and the conveying of recording medium to the image forming apparatus 60 shown in FIG. 1. Therefore, only the image formation process of the image forming apparatus 80, which is different from that of the image forming apparatus 60 in the first embodiment, will be described.

The image forming portion 6130 is made up of primarily: a photosensitive belt 81; a charging apparatus 84; an exposing apparatus 611*a*; a developing apparatus 610; etc. The photosensitive belt 81 has a photosensitive layer as its surface layer. It is suspended and kept stretched by a driver roller 604, a steering member 1, a follower roller 617, and an inward transfer roller 82, and is driven in the direction indicated by an arrow mark V in the drawing. The follower roller 617 is allowed to freely rotate, and rotates following the movement of the photosensitive belt 81. The inward transfer roller 82 a roller disposed on the inward side of the photosensitive belt loop back up the photosensitive belt 81 against a transfer roller 83. As the photosensitive belt 81 is driven in the arrow V direction, its peripheral surface is uniformly charged by the charging apparatus 84. The charged portion of the peripheral surface of the photosensitive belt 81 is scanned by the exposing apparatus 611*a*, whereby an electrostatic latent image is formed on the photosensitive belt 81. More specifically, as the exposing apparatus 611*a* is driven, a beam of light is projected from the exposing apparatus 611*a* while being modulated with the inputted signals which reflect the information of the image to be formed. This beam of light is deflected by the beam deflecting means 611*b*, etc., so that it scans the charged area of the peripheral surface of the photosensitive belt 81. As a result, an electrostatic latent image is effected upon the peripheral surface of the photosensitive belt 81. Then, the electrostatic latent image is developed by the developing apparatus 610 which uses toner. As a result, a visible image is formed of toner, on the peripheral surface of the photosensitive belt 81 (visible image will be referred to as toner image, hereafter). The image forming and transferring operations similar to the one described above are carried out in yellow (Y), magenta (M), cyan (C), and black (BK) image forming portions, starting from the yellow (Y) image forming portion, that is, the most upstream one, sequentially and in a partially overlapping manner, with such timings that the images formed in the downstream image forming portions are layered upon the images form in the upstream image forming portions. Consequentially, a full-color toner image is effected on the photosensitive belt 81. Then, as the photosensitive belt 81 is circularly driven further, the full-color toner image is conveyed to the transfer nip, which is formed by the inward transfer roller 82 and outward transfer roller 83. The transfer of the full-color toner image onto the recording sheet S in the transfer nip, and the transfer timing, are basically the same as those of the image forming apparatus of the intermediary transfer type described with reference to FIG. 1. The transfer residual toner, that is, a small amount of toner remaining on the peripheral surface of the photosensitive belt 81 after the transfer, is recovered by the photosensitive member cleaner 85 to prepare the photosensitive belt 81 for the next image formation. In the case of the image forming apparatus shown in FIG. 11, it has four image forming portions 613, more specifically, image forming portions 613Y, 613M, 613C, and 613BK. However, the number of color toners of which a full-color image is formed, and the order in which monochromatic toner images, different in color, are formed, does not need to be limited to the above described ones.

The structural arrangement for supporting the steering member 1 in this embodiment is the same as that of the belt centering automatic mechanism described above with reference to FIGS. 3 and 4. That is, the steering member 1 doubles as a tension roller for providing the photosensitive belt 81 with a preset amount of tension. In the case of an image forming apparatus such as the image forming apparatus 80 shown in FIG. 11, the change in the attitude of the photosensitive belt 81 basically results in the misalignment among the monochromatic images, different in color, in the primary scan direction, similar to that which occurs in an image forming apparatus which uses an intermediary transfer belt. That is, as the image forming apparatus 80 is suddenly subjected to a substantial amount of external disturbance, its photosensitive belt 81 reacts in the same manner as shown in FIG. 16, unless it is provided with a means for minimizing the effects of the disturbance. Thus, the above described problems can be solved by employing the belt driving unit having the belt centering automatic mechanism in this embodiment of the present invention, which has a means for increasing the steering member in its resistance to the effects of a large amount of sudden external disturbance in proportion to the steering speed $d\beta/dt$.

As described above, the present invention which is related to a belt centering automatic mechanism based on the difference in friction is characterized in that it is provided with a means for increasing the amount of resistance R in proportion (theoretically) to the change in the steering angle $\beta$ of the steering member 97 per unit length of time t ($d\beta/dt$), instead of the steering angle $\beta$ alone. The characteristic of the steering action of a belt centering automatic mechanism based on friction is that its cycle of response is very long, that is, the peripheral surface of the steering shaft is in the range in which the rate of shear is very low. On the other hand, a large amount of sudden external disturbance, to which a belt centering automatic mechanism is desired to be virtually immune, makes the steering shaft substantial in shear speed. Therefore, as long as the belt centering automatic mechanism is operating in the normal range, the effects of the resistance R is very small; only as the image forming apparatus is suddenly subjected to a substantial amount of external disturbance, the resistance R becomes large enough to prevent the steering shaft from excessively react to the disturbance.

As described above, according to the present invention, as long as the shear speed of the peripheral the steering shaft remains low, the effect of the friction between the belt and friction rings is very small, and only as the belt centering automatic mechanism is subjected to a large amount of sudden external disturbance, the friction provide the steering member with a large amount of resistance to the external disturbance. In other words, the present invention can eliminate the flaw of conventional belt centering automatic mechanisms, that is, the excessive sensitivity to a large amount of sudden external disturbance. Therefore, it can provide a belt centering automatic mechanism which prevents a belt from being suddenly changed in attitude, and therefore, can minimize the misalignment among monochromatic color images, different in color, in the primary scan direction, which is attributable to the sudden change in the belt attitude.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 134185/2009 filed Jun. 3, 2009, which is hereby incorporated by reference.

What is claimed is:

1. A belt driving apparatus for rotationally driving a belt member, said belt driving apparatus comprising:

a stretching member for stretching the belt member;

steering means including a steering member having a rotatable portion which is rotatable with rotation of the belt member, frictional portions slidable relative to the belt member and provided at each of longitudinal outsides of said rotatable portion, and further including supporting means supporting said steering member, and a rotation shaft rotatably supporting said supporting means, said steering means being effective to steer the belt member by tilting said steering member by a force produced by sliding between said frictional portions and the belt member; and resisting force applying means for applying a resisting force against the force to tilt said steering member, the resisting force increasing with increase of an angular velocity of said steering member which is a rate of change of a tilt angle of said steering member around said rotation shaft per unit time.

2. An apparatus according to claim 1, wherein said resisting force applying means includes a rotational type damper using a viscous resistance with which the resisting force against the force to tilt said steering member increases with increase of a rotating speed around said rotation shaft.

3. An apparatus according to claim 1, wherein said resisting force applying means includes at least one direct movement type damper using a viscous resistance, which contacts said supporting means at a position away from said rotation shaft in a direction of an axis of the rotatable portion, wherein the resisting force increases with an increase of a tilting speed of said supporting means at a position where said direct movement type damper and said supporting means contact each other.

4. An apparatus according to claim 1, wherein during movement of the belt member, an inner surface of the belt member is always in contact with at least one of said frictional portions.

5. An apparatus according to claim 1, wherein the belt member is an intermediary transfer belt for carrying a toner image transferred from an image bearing member.

6. An apparatus according to claim 1, wherein the belt member is a transfer belt for carrying a recording material to an image forming station, wherein the recording material is separated from the belt member after a toner image is formed on the recording material.

7. An apparatus according to claim 1, wherein said frictional portions have respective friction coefficients larger than that of said rotatable portion.

8. An apparatus according to claim 1, wherein an area of contact between one of said frictional portions and the belt member exceeds a predetermined level that said steering member is tilted to steer the belt member.

9. An apparatus according to claim 1, wherein said frictional portions are made of electroconductive resin material.

10. An apparatus according to claim 1, wherein a torque required to rotate said frictional portions in a rotational direction of the belt member when the belt member is not driven is larger than a torque required to rotate said rotatable portion in the same direction.

11. An apparatus according to claim 1, wherein when the belt member is not driven, said frictional portions are prevented from rotating in a rotational direction of the belt member.

12. An image forming apparatus for forming an image comprising the belt member and said belt driving apparatus according to claim 1.

* * * * *